US005955399A

United States Patent [19]

Takao et al.

[11] Patent Number: 5,955,399

[45] Date of Patent: Sep. 21, 1999

[54] THERMAL TRANSFER IMAGE-RECEIVING SHEET

[75] Inventors: Shino Takao; Shinji Kometani; Hitoshi Saito, all of Tokyo, Japan

[73] Assignee: Dai Nippon Printing Co., Ltd., Japan

[21] Appl. No.: 08/877,992

[22] Filed: Jun. 18, 1997

Related U.S. Application Data

[62] Division of application No. 08/462,889, Jun. 5, 1995, Pat. No. 5,705,451, which is a division of application No. 08/307,449, Sep. 21, 1994, Pat. No. 5,462,911.

[30] Foreign Application Priority Data

| | | | |
|---|---|---|---|
| Sep. 24, 1993 | [JP] | Japan | 5-258841 |
| Oct. 5, 1993 | [JP] | Japan | 5-271171 |
| Jan. 10, 1994 | [JP] | Japan | 6-12073 |

[51] Int. Cl.[6] ..... B41M 5/035; B41M 5/38

[52] U.S. Cl. ..... 503/227; 428/195; 428/447; 428/913; 428/914

[58] Field of Search ..... 8/471; 428/195, 428/447, 913, 914; 503/227

[56] References Cited

U.S. PATENT DOCUMENTS

| | | | |
|---|---|---|---|
| 5,260,255 | 11/1993 | Sudo et al. | 503/227 |
| 5,462,911 | 10/1995 | Takao et al. | 503/227 |

FOREIGN PATENT DOCUMENTS

| | | | |
|---|---|---|---|
| 61-112693 | 5/1986 | Japan | 503/227 |
| 1-44781 | 2/1989 | Japan | 503/227 |
| 1-241491 | 9/1989 | Japan | 503/227 |
| 2-217283 | 8/1990 | Japan | 428/195 |
| 3-140293 | 6/1991 | Japan | 503/227 |
| 5-208564 | 8/1993 | Japan | 503/227 |
| 6-1086 | 1/1994 | Japan | 503/227 |

*Primary Examiner*—Bruce H. Hess
*Attorney, Agent, or Firm*—Parkhurst & Wendel, L.L.P

[57] ABSTRACT

A thermal transfer image-receiving sheet comprising a substrate sheet, a dye-receptive layer provided on one surface of the substrate sheet and a dye-unreceptive layer provided on the other surface of the substrate sheet, the dye-unreceptive layer comprising a release agent which is the same as that contained in the dye-receptive layer or does not migrate to other places, for example, comprises an amino-modified silicone and an epoxy-modified silicone or a product of a reaction of both of them, or an addition-polymerizable silicone or a cured product obtained by a reaction thereof.

A thermal transfer image-receiving sheet comprising a substrate sheet, a dye-receptive layer provided on one surface of the substrate sheet and a lubricious back surface layer provided on the other surface of the substrate sheet, the lubricious back surface layer being composed mainly of a binder and a nylon filler.

3 Claims, 1 Drawing Sheet

THERMAL TRANSFER IMAGE-RECEIVING SHEET

This is a Division of application Ser. No.08/462,889 filed Jun. 5, 1995, now U.S. Pat. No. 5,705,451 which in turn is a Division of application Ser. No. 08/307,449 filed Sep. 21, 1994, now U.S. Pat. No. 5,462,911.

BACKGROUND OF THE INVENTION

The present invention relates to a thermal transfer image-receiving sheet which is receptive to a dye transferred from a thermal transfer sheet by heating, which thermal transfer image-receiving sheet can be widely utilized in the field of various color printers including video printers.

In recent years, a system where video images, TV images and still images, such as computer graphics, are directly printed as a full color image has advanced, which has led to a rapid expansion of the market thereof.

Among others, a system which has attracted attention is such that a sublimable dye as a recording material is put on an image-receiving sheet and heated by means of a thermal head in response to recording signals to transfer the dye onto the image-receiving sheet, thereby forming a recorded image.

In this recording system, since a dye is used as the colorant, the sharpness is very high and, at the same time, the transparency is excellent, so that it is possible to provide an image having excellent reproduction and gradation of intermediate colors equivalent to those of an image formed by the conventional full color offset printing and gravure printing. In this case, the formed image has a high quality comparable to photographic images.

Printers in current use in the above thermal transfer system are mainly of such a type that a thermal transfer image-receiving sheet is automatically carried to a thermal transfer section within a printer and, after printing, automatically delivered from the printer. Further, in order to carry out overlap printing of three colors or four colors, it is a common practice to provide a detection mark on the thermal transfer image-receiving sheet in its image-unreceptive surface, that is, the back surface, located opposite to the image-receiving surface for the purpose of preventing the occurrence of a shear in the printing position of each color.

Not only the construction of the thermal transfer sheet but also the construction of the image-receiving sheet on which an image is to be formed is important to the practice of the above thermal transfer method with a high efficiency. In particular, the properties of the image-unreceptive surface (back surface) located opposite to the image-receptive surface of the thermal transfer image-receiving sheet are important for smoothly carrying out automatic feed and delivery of the thermal transfer image-receiving sheet.

For example, when the image-receiving sheets with an image being formed thereon are put on top of another for storage, the dye on the print surface migrates to the back surface of another thermal transfer image-receiving sheet in contact with the print surface to remarkably stain the back surface, which deteriorates the appearance. Further, in this case, the color of the print surface is partly or entirely dropped out, or restaining occur.

Furthermore, in domestic use, a back surface free from a detection mark as in photographic paper is preferred from the viewpoint of appearance. However, when no detection mark is provided, it is difficult to distinguish the image-receptive layer from the back surface. When the thermal transfer image-receiving sheet is set in a printer in such a state that the image-receiving surface and the back surface are inversive, the erroneous setting cannot be detected by the printer and the printer begins to print.

If that happens, in the conventional thermal transfer image-receiving sheet, fusing between the thermal transfer sheet and the back surface of the thermal transfer image-receiving sheet occurs within the printer, which inhibits the thermal transfer image-receiving sheet from being delivered from the printer, so that the printer should be sent to a maker for repair.

The provision of a dye-receptive layer on both surfaces of the substrate sheet is considered as a means for solving the problem of heat fusing of the back surface. In this case, however, when prints are put on top of one another for storage, the dye migrates to cause problems of a lowering in image density, staining of contact surface, restaining and the like. Furthermore, since the dye-receptive layer comprises a dyeable resin and is even, the image-receptive layers are likely to come into close contact with each other, which, also in the stage before printing, results in a problem of a failure in automatic feed such as a problem that a plurality of image-receiving sheets are carried together in an overlapped state in a feeder of a printer. For example, even though a filler is added to the image-receptive layer for the purpose of preventing the occurrence of this problem, the highlight portion of the print is likely to become unsharp.

Another means for solving the above problem is to add a release agent to the back surface layer as a dye-unreceptive layer. However, if the release agent is added in an amount sufficient to impart satisfactory releasability, the releasing component contained in the back surface layer is transferred to the image-receptive surface when the back surface layer is put on top of the image-receptive surface, which unfavorably raises problems of occurrence of a failure in printing such as partial dropout in the print portion and uneven print density, a lowering in coefficient of dynamic friction between the image-receptive surface of the image-receiving sheet and the transfer agent surface of the thermal transfer sheet, which is causative of the occurrence of a shear in the printing position of each color. Further, in this case, the releasing component contained in the back surface layer migrates to a feed and delivery mechanism, such as a paper feed rubber roller, and a platen rubber roller in a printer, which gives rise to a change in coefficient of friction of these members, so that troubles are likely to occur such as a failure in feed and delivery of sheets and oblique carrying of the image-receiving sheet.

Accordingly, an object of the present invention is to solve the above problems of the prior art and to provide a thermal transfer image-receiving sheet having excellent service properties for use in a thermal transfer system where a sublimable dye is used, which thermal transfer image-receiving sheet hardly causes a lowering in print density and migration of dye to the back surface of the image-receiving sheet when a plurality of image-receiving sheets are put on top of another for storage, can be delivered from the printer without fusing to the thermal transfer sheet by virtue of excellent releasability of the back surface even though printing is carried out on the thermal transfer image-receiving sheet with the image-receiving surface and the back surface being inversive and is free from an adverse effect of the release agent added to the back surface layer on the image-receiving surface and substantially free from the migration of the release agent to a sheet feed and delivery mechanism and a platen rubber roller.

DISCLOSURE OF INVENTION

The present inventors have made extensive and intensive studies with a view to solving the above problems, which has led to the completion of the present invention.

Specifically, according to the first aspect of the present invention, there is provided a thermal transfer image-receiving sheet comprising a substrate sheet, a dye-receptive layer provided on one surface of said substrate sheet and a dye-unreceptive layer provided on the other surface of said substrate sheet, the dye-unreceptive layer comprising a composition composed mainly of at least one thermoplastic resin having at least one reactive functional group and an isocyanate compound or a chelate compound.

According to the second aspect of the present invention, there is provided a thermal transfer image-receiving sheet comprising a substrate sheet, a dye-receptive layer provided on one surface of said substrate sheet and a dye-unreceptive layer provided on the other surface of said substrate sheet, said dye-unreceptive layer comprising at least one release agent at least one of which is the same as that contained in said dye-receptive layer.

According to the third aspect of the present invention, there is provided a thermal transfer image-receiving sheet comprising a substrate sheet, a dye-receptive layer provided on one surface of said substrate sheet and a dye-unreceptive layer provided on the other surface of said substrate sheet, said dye-unreceptive layer comprising at least one release agent at least one of which does not migrate to said dye-receptive layer.

According to the fourth aspect of the present invention, there is provided a thermal transfer image-receiving sheet comprising a substrate sheet, a dye-receptive layer provided on one surface of said substrate sheet and a dye-unreceptive layer provided on the other surface of said substrate sheet, said dye-unreceptive layer comprising at least one release agent at least one of which comprises a cured product obtained by a reaction of a reactive silicone oil.

According to the fifth aspect of the present invention, there is provided a thermal transfer image-receiving sheet comprising a substrate sheet, a dye-receptive layer provided on one surface of said substrate sheet and a dye-unreceptive layer provided on the other surface of said substrate sheet, said dye-unreceptive layer comprising at least one release agent at least one of which comprises wax.

According to a sixth aspect of the present invention, there is provided a thermal transfer image-receiving sheet comprising a substrate sheet, a dye-receptive layer provided on one surface of said substrate sheet and a lubricious back surface layer provided on the other surface of said substrate sheet, said lubricious back surface layer comprising a binder and a nylon filler.

BEST MODE FOR CARRYING OUT THE INVENTION

Preferred embodiments of the present invention will now be described in more detail with reference to the accompanying drawings.

First Aspect of Invention

Figure 1:
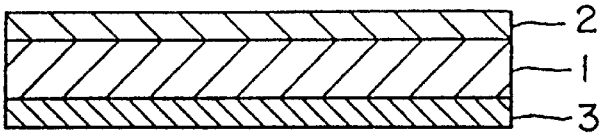
FIG. 1 is a cross-sectional view of an embodiment of the thermal transfer image-receiving sheet according to the present invention.

A typical cross-sectional view of an embodiment of the thermal transfer image-receiving sheet according to the first aspect of the present invention is shown in FIG. 1. This thermal transfer image-receiving sheet comprises a substrate sheet 1, a dye-receptive layer 2 provided on one surface of the substrate sheet and a dye-unreceptive layer 3 as a back surface provided on the other surface of the substrate sheet, characterized in that the dye-unreceptive layer 3 comprises a composition composed mainly of at least one thermoplastic resin having at least one reactive functional group and an isocyanate compound or a chelate compound.

Materials for constituting each layer of the thermal transfer image-receiving sheet of the present invention will now be described.

1) Substrate sheet

In the present invention, materials usable in the substrate sheet include papers. Any of various papers per se, converted papers and other types of papers may be used, and examples thereof include wood free paper, coated paper, art paper, cast coated paper and fiber board and other types of papers such as paper impregnated with an resin emulsion, a synthetic rubber latex or the like and paper containing an internally added synthetic resin. Further, a laminated paper comprising the above paper and various plastic films may also be used.

When synthetic paper is used, polystyrene synthetic paper, polyolefin synthetic paper and the like are preferred. Examples of the plastic film include a polyolefin resin film, a hard polyvinyl chloride film, a polyester resin film, a polystyrene film, a polycarbonate film, a polyacrylonitrile film and a polymethacrylate film. These plastic films are not particularly limited, and use may be made of not only transparent films but also a white opaque film or an expanded film prepared by adding a white pigment or filler to the above synthetic resin and forming a film from the mixture or expanding the mixture.

The above materials may be used alone. Alternatively, as described above in connection with paper, they may be used as a laminate comprising a combination thereof with other materials. Further, in the formation of a dye-receptive layer or a dye-unreceptive layer (a back surface layer) on the above substrate sheet, it is also possible to conduct a corona discharge treatment or provide a primer coating or an intermediate layer according to need. The thickness of the substrate sheet is in the range of from about 10 $\mu$m to 400 $\mu$m, preferably in the range of from 100 to 300 $\mu$m.

2) Dye-receptive layer

In the thermal transfer image-receiving sheet of the present invention, the dye-receptive layer is not particularly limited and may be any known dye-receptive layer commonly used in the sublimation thermal dye transfer system. For example, the following materials may be used.

(i) Resins having an ester bond Polyester resins, polyacrylic ester resins, polycarbonate resins, polyvinyl acetate resins, styrene acrylate resins, vinyltoluene acrylate resins and the like.

(ii) Resins having a urethane bond Polyurethane resins and the like.

(iii) Resins having an amide bond Polyamide resins and the like.

(iv) Resins having a urea bond Urea resins and the like.

(v) Other resins having a high polarity Polycaprolactone resins, styrene/maleic anhydride resins, polyvinyl chloride resins, polyacrylonitrile resins and the like.

In addition to the above synthetic resins, mixtures or copolymers thereof may also be used.

In the thermal transfer, the dye-receptive layer is brought in contact with a thermal transfer sheet, and the laminate is pressed with heating by means of a thermal head or the like, so that the dye-receptive layer is likely to stick to the surface of the thermal transfer sheet. For this reason, in the formation of the dye-receptive layer, a releasing agent permeable to a dye is generally incorporated into the above resin. Solid waxes, fluorine or phosphoric ester surfactants, silicone oils may be used as the release agent. Although the silicone oils may be in an oil form, reaction-curable silicone oils are preferred. for example, a combination of an amino-modified silicone with an epoxy-modified silicone is preferred.

The amount of the release agent added is 5 to 50% by weight, preferably 10 to 20% by weight, based on the weight of the resin when the release agent is solid wax, and 0.5 to 10% by weight based on the resin when the release agent is a fluorine or phosphoric ester surfactant. The curable silicone oils may be used in a large amount because they are not sticky, and the amount of the curable silicone oils added may be in the range of from 0.5 to 30% by weight based on the amount of the resin. In all the above release agents, when the amount is excessively small, the releasing effect becomes unsatisfactory. On the other hand, when the amount is excessive, the receptivity to a dye is lowered, so that insufficient recording density and other adverse effects occur.

Regarding the method for imparting releasability to the dye-receptive layer, besides the above-described incorporation of a release agent into the dye-receptive layer, it is also possible to separately provide a release layer on the dye-receptive layer. Further, if necessary, the dye-receptive layer may contain inorganic fillers such as finely divided silica.

The dye-receptive layer is formed by dissolving or dispersing the above-described materials for constituting the dye-receptive layer in a solvent to prepare a coating solution, coating the coating solution by gravure reverse coating or other coating methods and drying the resultant coating. In this case, the coverage may be in the range of from 1.5 to 15 $g/m^2$, preferably in the range of from 1.5 to 6.0 $g/m^2$.

3) Dye-unreceptive layer (back surface layer)

The thermal transfer image-receiving sheet according to the present invention is characterized by the dye-unreceptive layer (back surface layer). By virtue of the provision of the dye-unreceptive layer, the thermal transfer image-receiving sheet causes no staining of the back surface layer with a dye even when a plurality of image-receiving sheets after printing are put on top of one another for storage, has an excellent suitability for automatic feeding and can be delivered from the printer without fusing to a thermal transfer sheet by virtue of excellent releasability of the back surface even though it is fed into the printer with the back surface and the image-receiving surface being inversive.

For attaining the above properties, the dye-unreceptive layer comprises a composition composed mainly of at least one thermoplastic resin having at least one reactive functional group, preferably at least one vinyl resin having a hydroxyl group and an isocyanate compound or a chelate compound. If necessary, it may further comprise any one or both of an organic and/or inorganic filler and a release agent.

Furthermore, other thermoplastic resins may also be added for the purpose of improving the productivity and gloss in such an amount as will not be detrimental to the performance of the dye-unreceptive layer.

The regulation of the hydroxyl value in the vinyl resin is easier than that in polyester resins, polyolefin resins and polycarbonate resins and other resins, so that the degree of crosslinking can be easily controlled as desired, which enables the above-mentioned staining of the back surface caused by the migration of the dye to be easily prevented. Also from the viewpoint of production stability, the vinyl resin wherein the hydroxyl value can be easily regulated is preferred by taking into consideration easy optimization of the solubility in the solvent used, the pot life of the isocyanate compound or chelate compound, which is generally unstable against water, and the like.

Preferred examples of the vinyl resin include polyvinyl alcohol resin, polyvinyl formal resin, polyvinyl acetoacetal resin, polyvinyl butyral resin and vinyl chloride/vinyl acetate/polyvinyl alcohol copolymer resin. High Tg and hydrophilicity are desired from the viewpoint of resistance to staining with a dye, and the regulation of solubility in general-purpose solvents and viscosity are required from the viewpoint of production stability. For this reason, the polyvinyl butyral resin is particularly preferred.

Examples of the thermoplastic resin used in the present invention include vinyl resins, such as polyvinyl alcohol resins, polyvinyl acetate resins, polyvinyl chloride resins, vinyl chloride/vinyl acetate copolymer resins, acrylic resins, polystyrene resins, polyvinyl formal resins, polyvinyl acetoacetal resins and polyvinyl butyral resins, cellulosic resins, polyester resins and polyolefin resins. Thermoplastic resins having a reactive functional group and a low dyeability with a sublimable dye are still preferred.

The isocyanate compound may be any of an aromatic isocyanate and an aliphatic isocyanate, and the amount of the isocyanate compound added is preferably equal to or twice the amount of the reactive functional group of the thermoplastic resin having a reactive functional group.

The chelate compound may be a titanium chelate compound, a zirconium chelate compound, an aluminum chelate compound or the like. Chelate compounds having a high curing activity are preferred. The amount of the chelate compound added is 25 to 300 parts by weight based on 100 parts by weight of the thermoplastic resin having a reactive functional group.

Fillers used in the present invention are not particularly limited, and examples thereof include polyethylene wax, bisamides, polyamides, such as nylon, acrylic resins, crosslinked polystyrene, silicone resins, silicone rubbers, talc, calcium carbonate and titanium oxide. Fillers capable of improving the lubricity are preferred, and the particle diameter is suitably in the range of from 2 to 15 $\mu$m. Among the above materials, nylon 12 filler is particularly preferred from the viewpoint of resistance to offset of dye, that is, staining resistance, and good lubricity.

The amount of the filler added may be in the range of from 0 to 200 parts by weight based on 100 parts by weight in total of the thermoplastic resin and the release agent.

In the present invention, various surfactants, silicon compounds, fluorine compounds and other compounds may be used as the release agent. Among them, silicon compounds are preferred. Three-dimensional crosslinked silicones and reactive silicone oils are preferred from the viewpoint of avoiding the migration to other places. The reactive silicone oil is particularly preferred because the use thereof in a small amount can provide a sufficient releasability and there is no fear of the release agent migrating to other places. The silicone oil may be added in an oil form to the resin for constituting the dye-unreceptive layer, coated in a sufficiently dispersed state, dried and then crosslinked. Further, when the reactive silicone oil reacts with an isocyanate compound or a chelate compound as the curing agent for the thermoplastic resin, thereby causing the reactive silicone oil to be fixed to the resin, the fear of the migration can be completely eliminated.

Specific preferred examples of the reactive silicone include an amino-modified silicone and an epoxy-modified silicone and a cured product obtained by a reaction thereof, an addition-polymerizable silicone and a cured product obtained by a reaction thereof, and a radiation-curable silicone and a cured product obtained by a reaction thereof. Further preferred examples of the reactive silicone include a hydroxyl-modified silicone oil and a carboxyl-modified silicone oil having an active hydrogen which can be cured when used in combination with an isocyanate compound or a chelate compound.

The amount of the release agent added is suitably in the range of from 0 to 5 parts by weight based on 100 parts by weight of the thermoplastic resin.

In working examples which will be described later, wire bar coating was used for the formation of the dye-unreceptive layer (back surface layer) by coating from the viewpoint of convenience. However, the coating method is not particularly limited and may be freely selected from gravure coating, roll coating, blade coating, knife coating, spray coating and other conventional coating methods.

The thermal transfer image-receiving sheet according to the present invention comprises a substrate sheet, a dye-receptive layer provided on one surface of said substrate sheet and a dye-unreceptive layer provided on the other surface of said substrate sheet, the dye-unreceptive layer comprising a composition composed mainly of at least one thermoplastic resin having at least one reactive functional group, preferably a vinyl resin having a hydroxyl group, and an isocyanate compound or a chelate compound. The adoption of such a constitution brings the thermoplastic resin of the dye-unreceptive layer as a back surface layer of the image-receiving sheet to a crosslinked structure, which contributes to an improvement in heat resistance. This improves the suitability of the image-receiving sheet for automatic feed and delivery in a printer. Further, the sublimable dye receptivity of the dye-unreceptive layer in the image-receiving sheet can also be lowered, so that the stain of the back surface with a sublimable dye can be reduced even when a plurality of sheets are stored with the surface of the print facing the back surface.

Further, in the thermal transfer image-receiving sheet according to the present invention, the thermoplastic resin of the dye-unreceptive layer as the back surface may be a thermoplastic resin having a hydroxyl group as the reactive functional group, more specifically, polyvinyl formal, polyvinyl acetoacetal or polyvinyl butyral. This embodiment enables the thermoplastic resin to be more surely reacted, so that the above effect can be attained more efficiently and stably.

Furthermore, in the thermal transfer image-receiving sheet according to the present invention, the dye-unreceptive layer provided in the back surface may further comprise an organic filler and/or an inorganic filler or a release agent, or an organic filler and/or an inorganic filler and a release agent. According to this embodiment, the above effect can be further improved. Specifically, curing of the binder resin contributes to an improvement in heat resistance, and the addition of the release agent in the minimum required amount contributes to a further improvement in releasability and lubricity of the back surface of the thermal transfer image-receiving sheet. Further, since the release agent is fixed to the dye-unreceptive layer, it is not transferred to other places. Therefore, the automatic feed and delivery of the image-receiving sheet in a printer becomes more smooth. Furthermore, even though the thermal transfer sheet is fed into a printer with the back surface and the image-receiving surface of the image-receiving sheet being inversive and, in this state, printing is carried out, the sheet can be successfully delivered from the printer without the occurrence of heat fusing or sticking between the thermal transfer sheet and the back surface of the image-receiving sheet.

Second Aspect of Invention

The second aspect of the present invention will now be described in more detail with reference to the accompanying drawings. A typical cross-sectional view of an embodiment of the thermal transfer image-receiving sheet according to the second aspect of the present invention is shown in FIG. 1. This thermal transfer image-receiving sheet comprises a substrate sheet 1, a dye-receptive layer 2 provided on one surface of the substrate sheet and a dye-unreceptive layer 3 provided on the other surface of the substrate sheet, characterized in that the dye-unreceptive layer 3 comprises at least one release agent.

Materials for constituting each layer of the thermal transfer image-receiving sheet of the present invention will now be described.

1) Substrate sheet

In the present invention, materials usable in the substrate sheet include papers. Any of various papers per se, converted papers and other types of papers may be used, and examples thereof include wood free paper, coated paper, art paper, cast coated paper and fiber board and other types of papers such as paper impregnated with an resin emulsion, a synthetic rubber latex or the like and paper containing an internally added synthetic resin. When synthetic paper is used, polystyrene synthetic paper, polyolefin synthetic paper and the like are preferred.

Examples of plastic films as the substrate sheet include a polyolefin resin films, such as a polypropylene film, a polycarbonate film, a polyester resin film, such as a polyethylene naphthalate film or a polyethylene terephthalate film, a hard polyvinyl chloride film, a polystyrene film, a polyamide film, a polyacrylonitrile film, a polymethacrylate film, a polyetherether-ketone film, a polyethersulfone film and a polyallylate film. These plastic films are not particularly limited, and use may be made of not only transparent films but also a white opaque film or an expanded film prepared by adding a white pigment or filler to the above synthetic resin and forming a film from the mixture or expanding the mixture.

The above materials may be used alone or as a laminate comprising a combination thereof with other materials.

The laminate preferably has a three-layer structure which does not curl at the time of printing. For example, a structure comprising the above-described substrate sheet as a core material and a synthetic paper laminated to both sides of the core material. The synthetic paper provided on both sides of the core material may comprise a polyolefin, polystyrene or other synthetic paper. In particular, a synthetic paper provided with a paper-like layer having pores or a single-layer or a composite film having pores may be used. A polypropylene film provided with pores is particularly preferred.

Further, it is also possible to use a synthetic paper comprising an expanded film and, formed thereon, a thin film layer (about 2–20 μm) of a resin not containing a pigment. The thin film layer can improve the gloss and smoothness of the synthetic paper. This type of synthetic paper can be formed by laminating a thin film forming resin onto an expanded film prepared by molding a mixture of a resin, such as a polyester or a polyolefin, with fine particles of an inorganic materials, such as barium sulfate, into a sheet and subjecting the sheet to uniaxial or biaxial stretching. In this case, the thin film layer resin is preferably stretched simultaneously with the stretching of the expanded film.

The pores in the paper-like layer can be formed, for example, by stretching a synthetic resin with a fine filler being incorporated therein. In the formation of an image by thermal transfer, the thermal transfer image-receiving sheet having such a paper-like layer exhibit additional effects of providing a high image density and causing no variation in image. The reason why these additional effects can be attained is believed to reside in that a good thermal energy efficiency by virtue of heat insulation effect offered by the pores and good cushioning properties derived from the pores contribute to a receptive layer which is provided on the synthetic paper and on which an image is to be formed.

The laminate may be used for somewhat special purposes. For example, after an image is formed on the image-receiving sheet, the sheet can be used in applications such as sealing labels. In this case, a laminate sheet comprising the above substrate sheet and, laminated on the back surface thereof, a pressure-sensitive adhesive and a release paper or a release film may be used as a substrate sheet for the image-receiving sheet.

Further, in the formation of a dye-receptive layer or a dye-unreceptive layer (a back surface layer) on the above substrate sheet, it is also possible to conduct a corona discharge treatment or provide a primer coating or an intermediate layer on the substrate sheet according to need. The thickness of the substrate sheet is in the range of from about 10 μm to 400 μm, preferably in the range of from 100 to 300 μm.

2) bye-receptive layer

In the thermal transfer image-receiving sheet of the present invention, the dye-receptive layer is not particularly limited and may be any known dye-receptive layer commonly used in the sublimation thermal dye transfer system. For example, the following materials may be used.

(i) Resins having an ester bond Polyester resins, polyacrylic ester resins, polycarbonate resins, polyvinyl acetate resins, styrene acrylate resins, vinyltoluene acrylate resins and the like.

(ii) Resins having a urethane bond Polyurethane resins and the like.

(iii) Resins having an amide bond Polyamide resins and the like.

(iv) Resins having a urea bond Urea resins and the like.

(v) Other resins having a high polarity Polycaprolactone resins, styrene/maleic anhydride resins, polyvinyl chloride resins, polyacrylonitrile resins and the like.

In addition to the above synthetic resins, mixtures or copolymers thereof may also be used.

In the thermal transfer, the dye-receptive layer is brought in contact with a thermal transfer paper, and the laminate is pressed with heating by means of a thermal head or the like, so that the dye-receptive layer is likely to stick to the surface of the thermal transfer sheet. For this reason, in the formation of the dye-receptive layer, a releasing agent permeable to a dye is generally incorporated into the above resin. Examples of the release agent include solid waxes, such as paraffin wax, carnauba wax and polyethylene wax, silicone oils, gums, silicone resins, fluorocompounds and fluororesins. Among the silicone oils, those in an oil form are preferably epoxy-modified silicones, still preferably of reaction-curable type. For example, use may be made of a combination of an amino-modified silicone with an epoxy-modified silicone, and an addition-polymerizable silicone prepared by reacting a straight-chain methylvinylpolysiloxane having a vinyl group at its both ends or its both ends and chain with methylhydrogenpolysiloxane wherein the reaction is carried out in the presence of a platinum catalyst and, if necessary, the viscosity is modified with a solvent and, further, a reaction inhibitor is added.

Further, it is also possible to use a condensation-polymerizable silicone and a cured product obtained by a reaction thereof, a radiation-curable silicone and a cured product obtained by a reaction thereof and, further, a hydroxyl-modified silicone oil and a carboxyl-modified silicone oil having an active hydrogen which can be cured when used in combination with an isocyanate compound or a chelate compound.

The amount of the release agent added may be freely selected so far as it provides a satisfactory releasability. When it is excessive, the receptivity to dye is lowered, so that insufficient recording density and other adverse effects occur.

Regarding the method for imparting releasability to the dye-receptive layer, besides the above-described incorporation of a release agent into the dye-receptive layer, it is also possible to separately provide a release layer on the dye-receptive layer. Further, if necessary, the dye-receptive layer may contain inorganic fillers such as finely divided silica.

The dye-receptive layer is formed by dissolving or dispersing the above-described materials for constituting the dye-receptive layer in a solvent to prepare a coating solution, coating the coating solution by gravure reverse coating or other coating methods and drying the resultant coating. In this case, the coverage may be in the range of from 1.5 to 15 $g/m^2$, preferably in the range of from 1.5 to 6.0 $g/m^2$.

3) Dye-unreceptive layer (back surface layer)

The thermal transfer image-receiving sheet according to the present invention is characterized by the dye-unreceptive layer (back surface layer). By virtue of the provision of the dye-unreceptive layer, the thermal transfer image-receiving sheet has an excellent suitability for automatic feed and delivery, can be delivered from the printer without fusing to a thermal transfer sheet by virtue of excellent releasability of the back surface even though it is fed into the printer with the back surface and the image-receiving surface being inversive and causes no staining of the back surface layer with a dye even when a plurality of image-receiving sheets after printing are put on top of one another for storage. For attaining the above properties, the dye-unreceptive layer comprises a composition containing at least one release agent and, if necessary, further comprises at least one thermoplastic resin and an organic and/or inorganic filler and the like.

In the present invention, examples of the release agent used in the dye-unreceptive layer of the image-receiving sheet include solid waxes, such as paraffin wax and polyethylene wax, and various silicone compounds. Basically, release agents of such a type as does not migrate to the dye-receptive layer and other places are preferred. For example, when silicon compounds are used, three-dimensional crosslinked silicones and reactive silicone oils are suitable from the viewpoint of avoiding the migration to other places. The reactive silicone oil is particularly preferred because the use thereof in a small amount can provide a sufficient releasability and there is no fear of the release agent migrating to other places. The silicone oil may be incorporated in an oil form into the composition for constituting the dye-unreceptive layer, coated in a sufficiently dispersed state, dried and then crosslinked. Specific examples of the silicone of the type described above include an addition-polymerizable silicone or a cured product obtained by a reaction thereof, for example, a condensation-polymerizable silicone and a cured product obtained by a reaction thereof, an epoxy-modified silicone oil and an amino-modified silicone oil or a cured product obtained by a reaction thereof and a radiation-curable silicone or a cured product obtained by a reaction thereof. Further, a hydroxyl-modified silicone oil and a carboxyl-modified silicone oil having an active hydrogen which can be cured when used in combination with an isocyanate compound or a chelate compound are also preferred.

The release agent contained in the dye-unreceptive layer is preferably the same as that contained in the dye-receptive layer. In the dye-receptive layer, a release agent having a high permeability to a dye is used so as not to inhibit the dye transfer, and the use of the same release agent in the dye-unreceptive layer offers such an advantage that even though part of the release agent migrates to the dye-receptive layer located on the surface of the image-receiving sheet, the release agent is likely to be homogeneously mixed with the release agent contained in the receptive layer to form an even film and, further, since the permeability to a dye is so high that the dye receptivity of the receptive layer is not lowered.

Specific examples of the release agent of this type are described above in connection with the dye-receptive layer. Among them, the epoxy-modified silicone is particularly preferred. Further, when the above-described reaction-curable silicones are used as a nonmigratory release agent in both the dye-receptive layer and the dye-unreceptive layer, they do not affect each other and, hence, can sufficiently exhibit their respective contemplated properties.

Among the above reaction-curable silicones, the addition-polymerizable silicone is particularly preferred from the viewpoint of curing rate. The term "addition-polymerizable silicone" is intended to mean a silicone compound having an addition-polymerizable group, a hydrogen-modified silicone compound and a cured product obtained by a reaction thereof. The curing reaction is preferably carried out in the presence of a platinum catalyst. If necessary, the silicone may be regulated to a suitable viscosity with a solvent, and a reaction inhibitor may be added thereto. The addition-polymerizable silicone compound and the hydrogen-modified silicone compound are known from Silicone Handbook (Sirikon Handobukku) (The Nikkan Kogyo Shimbun, Ltd.) to have the following respective structural formulae:

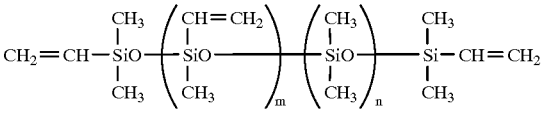

wherein m+n=20–2,000; and

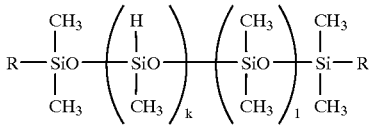

wherein R=—$CH_3$ or H and k+1=8–98.

From Silicone Handbook (Sirikon Handobukku) (The Nikkan Kogyo Shimbun, Ltd.), it is known that in the above structural formulae, an ethyl group, a phenyl group or a 3,3,3-trifluoropropyl group may be substituted for the methyl group.

When the above silicone compound is used in combination with the following resin, it is still preferred to substitute a phenyl group for part of the methyl groups from the viewpoint of improving the compatibility of the silicone compound with the resin. The percentage phenyl substitution is preferably in the range of from 20 to 80% based on the whole methyl group for each structural formula.

The active hydrogen of the hydroxyl-modified silicone oil or carboxyl-modified silicone oil having an active hydrogen preferably modifies not only an end or both ends but also a side chain, and the OH value is preferably 10 to 500 mg KOH/g, still preferably 100 to 500 mg/KOH/g, while the COOH equivalent is preferably 1000 to 50,000 g/mol, still preferably 3,000 to 50,000 g/mol.

Examples of the thermoplastic resin which may be used in the dye-unreceptive layer include vinyl resins, such as polyvinyl alcohol resins, polyvinyl acetate resins, polyvinyl chloride resins, vinyl chloride/vinyl acetate copolymer resins, acrylic resins, polystyrene resins, polyvinyl formal resins, polyvinyl acetoacetal resins and polyvinyl butyral resins, cellulosic resins, polyester resins and polyolefin resins.

The use of these resins in combination with the silicone improves the adhesion of the dye-unreceptive layer to the substrate sheet as compared with the use of the silicone alone. Further, when these thermoplastic resins have a reactive functional group, such as a hydroxyl group or a carboxyl group, the addition of an isocyanate compound, such as an aromatic or aliphatic isocyanate compound, or a chelate compound, such as a titanium, zirconium or aluminum chelate compound, followed by curing reduces the bite of the dye binder resin at the time of printing and improves the fixation of the release agent to the non-receptive layer, so that stable releasability can be obtained and, at the same time, the resistance to staining with a dye is improved.

Fillers used in the present invention are not particularly limited, and examples thereof include fine particles of polyethylene wax, bisamides, polyamides, acrylic resins, crosslinked polystyrene, silicone resins, silicone rubbers, talc, calcium carbonate and titanium oxide. Fillers capable of improving the lubricity are preferred, and nylon 12 filler is particularly preferred. The addition of these fillers causes the surface of the dye-unreceptive layer to become finely uneven. This improves the lubricity and, at the same time, the stain of the back surface with a sublimable dye can be reduced even when a plurality of image-receiving sheets after printing are stored with the surface of the print facing the back surface.

The particle diameter of the filler is suitably in the range of from about 2 to 15 $\mu$m, and the amount of the filler added may be in the range of from 0 to 67% by weight based on the dye-unreceptive layer composition (on a solid basis).

In working examples which will be described later, wire bar coating was used for the formation of the dye-unreceptive layer (back surface layer) by coating from the viewpoint of convenience. However, the coating method is not particularly limited and may be freely selected from gravure coating, roll coating, blade coating, knife coating, spray coating and other conventional coating methods. The coverage of the dye-unreceptive layer is preferably as low as possible from the viewpoint of cost so far as the releasability is satisfactory.

When the adhesion of the dye-unreceptive layer to the substrate sheet is poor depending upon the material for the substrate sheet, it is possible to provide a primer layer.

As is apparent from the foregoing detailed description, the thermal transfer image-receiving sheet according to the second aspect of the present invention comprises a substrate sheet, a dye-receptive layer provided on one surface of the substrate sheet and a dye-unreceptive layer provided on the other surface of the substrate sheet, characterized in that the dye-unreceptive layer comprises at least one release agent. If necessary, it may further comprises at least one thermoplastic resin and an organic and/or inorganic filler.

By virtue of the above constitution, the dye-unreceptive layer as the back surface layer of the image-receiving sheet has excellent releasability and heat resistance, so that even though the image-receiving sheet is fed into a printer with the back surface and the image receiving sheet of the image-receiving sheet being inversive and, in this state, printing is carried out, the image-receiving sheet can be successfully delivered from the printer without heat fusing of the dye-unreceptive layer to the thermal transfer sheet.

Further, the receptivity of the dye-unreceptive layer to sublimable dye is so low that even when image-receiving sheets with an image being recorded thereon are put on top of one another for storage, there is no possibility that the back surface is stained with a dye.

Further, when the dye-unreceptive layer contains a thermoplastic resin and/or an organic or inorganic filler, the lubricity of the back surface of the image-receiving sheet can be controlled as desired, which improves the carriability of the image-receiving sheet in automatic feed and delivery in a printer. Furthermore, in this case, since the filler renders the surface of the dye-unreceptive layer finely uneven, even when the image-receiving sheets after printing are put on top of one another and, in this state, are stored, the image-receiving surface is not adhered to the back surface of the image-receiving sheet, so that the effect of preventing the back surface from staining with a sublimable dye can also be attained.

Third Aspect of the Invention

Embodiments of the third aspect of the present invention will now be described in more detail with reference to the accompanying drawings.

Figure 2:
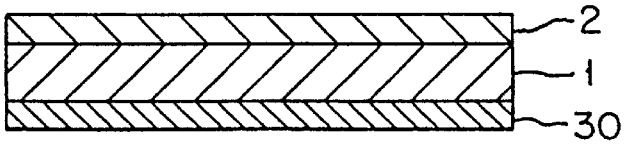
FIG. 2 is a cross-sectional view of another embodiment of the thermal transfer image-receiving sheet according to the present invention.

A typical cross-sectional view of an embodiment of the thermal transfer image-receiving sheet according to the third aspect of the present invention is shown in FIG. 2. This thermal transfer image-receiving sheet comprises a substrate sheet 1, a dye-receptive layer 2 provided on one surface of the substrate sheet and a lubricious back surface layer 30 provided on the other surface of the substrate sheet, characterized in that the lubricious back surface layer 30 is composed mainly of a binder and a nylon filler.

Materials for constituting each layer of the thermal transfer image-receiving sheet of the present invention will now be described.

1) Substrate sheet

In the present invention, materials usable in the substrate sheet include papers. Any of various papers per se, converted papers and other types of papers may be used, and examples thereof include wood free paper, coated paper, art paper, cast coated paper and fiber board and other types of papers such as paper impregnated with an resin emulsion, a synthetic rubber latex or the like and paper containing an internally added synthetic resin. Further, a laminated paper comprising the above paper and various plastic films.

When synthetic paper is used, polystyrene synthetic paper, polyolefin synthetic paper and the like are suitable. Examples of the plastic film include a polyolefin resin film, a polyvinyl chloride film, a polyester resin film, a polystyrene film, a polycarbonate film, a polyacrylonitrile film and a polymethacrylate film. These plastic films are not particularly limited, and use may be made of not only transparent films but also a white opaque film or a foamed film prepared by adding a white pigment or filler to the above synthetic resin and forming a film from the mixture or expanding the mixture.

When plastic films are used, plasticizers and other additives may be optionally added for the purpose of regulating the rigidity of the films.

The above materials may be used alone. Alternatively, as described above in connection with paper, they may be used as a laminate comprising a combination thereof with other materials. Further, in the formation of a dye-receptive layer or a lubricious back surface layer on the above substrate sheet, it is also possible to conduct a corona discharge treatment or provide a primer coating or an intermediate layer according to need.

The thickness of the substrate sheet is in the range of from about 10 $\mu$m to 400 $\mu$m, preferably in the range of from about 100 $\mu$m to 300 $\mu$m.

When the image-receiving sheet is used in applications where an translucent image is required, such as OHP sheets, a transparent polyethylene terephthalate sheet having a thickness of about 50 to 200 $\mu$m is suitable.

2) Dye-receptive layer

In the thermal transfer image-receiving sheet of the present invention, the dye-receptive layer is not particularly limited and may be any known dye-receptive layer commonly used in the sublimation thermal dye transfer system. For example, the following materials may be used.

(i) Resins having an ester bond Polyester resins, polyacrylic ester resins, polycarbonate resins, polyvinyl acetate resins, styrene acrylate resins, vinyltoluene acrylate resins and the like.

(ii) Resins having a urethane bond Polyurethane resins and the like.

(iii) Resins having an amide bond Polyamide resins and the like.

(iv) Resins having a urea bond Urea resins and the like.

(v) Other resins having a high polarity Polycaprolactone resins, styrene/maleic anhydride resins, polyvinyl chloride resins, polyacrylonitrile resins and the like.

In addition to the above synthetic resins, mixtures or copolymers thereof may also be used.

In the thermal transfer, the dye-receptive layer is brought in contact with a thermal transfer sheet, and the laminate is pressed with heating by means of a thermal head or the like, so that the dye-receptive layer is likely to stick to the surface of the thermal transfer sheet. For this reason, in the formation of the dye-receptive layer, a releasing agent permeable to a dye is generally incorporated into the above resin. Solid waxes, fluorine or phosphoric ester surfactants, silicone oils may be used as the release agent. Although the silicone oils may be in an oil form, reaction-curable silicone oils may be preferred. For example, a combination of an amino-modified silicone with an epoxy-modified silicone is preferred.

The amount of the release agent added is 5 to 50% by weight, preferably 10 to 20% by weight, based on the weight of the resin when the release agent is solid wax, and 0.5 to 10% by weight based on the resin when the release agent is a fluorine or phosphoric ester surfactant. The curable silicone oils may be used in a large amount because they are not sticky, and the amount of the curable silicone oils added may be in the range of from 0.5 to 30% by weight. In all the above release agents, when the amount is excessively small, the releasing effect becomes unsatisfactory. On the other hand, when the amount is excessive, the receptivity to a dye is lowered, so that insufficient recording density and other adverse effects occur.

Regarding the method for imparting the releasability to the dye-receptive layer, besides the above-described incorporation of a release agent into the dye-receptive layer, it is also possible to separately provide a release layer on the dye-receptive layer. Further, if necessary, the dye-receptive layer may contain inorganic fillers, such as finely divided silica and titanium oxide, antioxidants and ultraviolet absorbers.

The dye-receptive layer may be formed on the substrate sheet, for example, by coating the substrate sheet with a suitable organic solvent solution or water or organic solvent dispersion of above materials by gravure printing, screen printing or reverse roll coating using a gravure print or die coating and drying the resultant coating. For some materials, it is possible to form the dye-receptive layer by melt extrusion coating without use of any organic solvent and water.

Although the dye-receptive layer thus formed may have any desired thickness, the thickness is generally in the range of from 1 to 50 $\mu$m.

3) Lubricious back surface layer

The thermal transfer image-receiving sheet of the resent invention is mainly characterized by the lubricious back surface layer. The lubricious back surface layer serves to prevent the image-receiving sheet from curling at the time of thermal transfer from the thermal head by heat, to improve the antiblocking resistance and lubricity in such a state that a plurality of thermal transfer image-receiving sheets are put on top of one another, and to prevent the staining of the back surface of the image-receiving sheet caused by migration of a dye of the print during storage of image-receiving sheets after printing with the print surface facing the back surface.

For attaining the above effects, the lubricious back surface layer is composed mainly of a resin having a low dyeability with a dye as a binder and a nylon filler incorporated into the binder.

Specific examples of the above binder, that is, a resin having a low dyeability with a dye include acrylic resins, polystyrene resins, polyolefin resins, polyamide resins, polyvinyl butyral, polyvinyl alcohol and cellulose acetate resins. In addition, curing resins obtained by curing polyvinyl butyral, melamine, cellulose, acrylic resins and other resins by using a chelate, an isocyanate, irradiation with a radiation and other means are also preferred.

The above examples of the resin are illustrative only, and the binder is not limited to the above resins only. Specifically, various other resins may be used so far as they have a low dyeability with a dye, and the resins may be used in the form of a mixture of two or more.

The nylon filler is preferably one which has a molecular weight of 100,000 to 900,000, is spherical and has an average particle diameter of 0.01 to 30 $\mu$m, particularly preferably one which has a molecular weight of 100,000 to 500,000 and an average particle diameter of 0.01 to 10 $\mu$m.

Regarding the kind of nylon fillers, nylon 12 filler is more preferred than nylon 6 and nylon 66 fillers because it has superior water resistance and gives rise to no change in properties upon water absorption.

The nylon filler has a high melting point and good heat stability, oil resistance, chemical resistance and other properties and, therefore, is less likely to be dyed with a dye. Further, it has a self-lubricity and a low coefficient of friction and, when it has a molecular weight of 100,000 to 900,000, is hardly abraded and does not damage counter materials.

The average particle diameter is preferably in the range of from 0.1 to 30 $\mu$m in the case of a thermal transfer image-receiving sheet for a reflection image and in the range of from 0.01 to 1 $\mu$m for a thermal transfer image-receiving sheet for a transparency image. When the particle diameter is excessively small, the filler is buried in the lubricious back surface layer, so that the function of lubricity is unsatisfactory. On the other hand, when the particle diameter is excessively large, the protrusion of the filler from the lubricious back surface layer becomes large, which unfavorably enhances the coefficient of friction and causes falling of the filler.

The proportion of the nylon filler incorporated into the binder is preferably in the range of from 0.01 to 200% by weight. It is still preferably in the range of from 1 to 100% by weight in the case of a thermal transfer image-receiving sheet for a reflection image and in the range of from 0.05 to 2% by weight in the case of a thermal transfer image-receiving sheet for a transparency image. When the proportion of the nylon filler incorporated is less than 0.01% by weight, the lubricity is unsatisfactory, so that clogging of the sheet and other unfavorable phenomena occur. On the other hand, when it exceeds 200% by weight, the lubricity is so high that a shear in the printing position of colors and other unfavorable phenomena unfavorably occur.

The lubricious back surface layer may be generally formed by coating a suitable organic solvent solution or water or organic solvent dispersion of the binder resin containing a nylon filler in the above-described suitable amount range and optional additives by a gravure printing method, a screen printing method, a reverse roll coating method using a gravure print or a die coating method and drying the resultant coating. For some materials, it is also possible to form the lubricious back surface layer by melt extrusion coating without use of any solvent and dispersion medium.

The thickness of the lubricious back surface layer is generally in the range of from 1 to 70 $\mu$m.

In the thermal transfer using the above-described thermal transfer image-receiving sheet according to the present invention, the thermal transfer sheet used, for example, comprises paper or a polyester film and, provided thereon, a dye transfer layer containing a sublimable dye and, optionally provided on the back surface of the paper or polyester film, a heat-resistance layer, and any conventional thermal transfer sheet, as such, may be used in the present invention. Also for a device used in the thermal transfer, any conventional device may be used. For example, a desired object can be sufficiently attained by applying a thermal energy of about 5 to 100 mJ/mm$^2$ through the control of a recording time by means of a thermal printer (for example, a video printer VY-100 manufactured by Hitachi, Limited).

The thermal transfer image-receiving sheet according to the third aspect of the present invention comprises a substrate sheet, a dye-receptive layer provided on one surface of the substrate sheet and a lubricious back surface layer provided on the other surface of the substrate sheet, the lubricious back surface layer being composed mainly of a binder and a nylon filler. By virtue of the above construction, the surface of the lubricious back surface layer of the image-receiving sheet is finely uneven, which contributes to an improvement in lubricity and blocking resistance, so that troubles in a printer can be eliminated such as feed of a plurality of sheets in an overlapped state and other troubles during carrying such as in automatic feed and delivery. Further, since the nylon filler has a high melting point and a self-lubricity and excellent oil and chemical resistance, even though the temperature of the image-receiving sheet is raised within a printer, the lubricity and the blocking resistance are not deteriorated, so that stable properties can be obtained. Furthermore, even when a plurality of image-receiving sheets are put on top of one another with the surface of the print facing the back surface and, in this state, are stored, staining of the back surface of the image-receiving sheet with a sublimable dye hardly occurs.

In the thermal transfer image-receiving sheet according to the present invention, the nylon filler added to the back surface layer is a nylon 12 filler. The nylon 12 filler is superior to nylon 6 and nylon 66 in water resistance and less likely to absorb water, so that under high-humidity conditions it gives rise to no change in properties and can stably exhibit the above properties.

Further, in the thermal transfer image-receiving sheet according to the present invention, the nylon filler may be spherical and have a molecular weight in the range of from 100,000 to 900,000.

This embodiment contributes to a further improvement in lubricity and blocking resistance of the back surface of the image-receiving sheet and an improvement in abrasion resistance of the filler. Therefore, there is no possibility that powder generated by abrasion is transferred to the rubber roller and the like and damages the rubber roller and other counter materials, which contributes to a further improvement in stability.

Furthermore, in the thermal transfer image-receiving sheet according to the present invention, the nylon filler may have an average particle diameter in the range of from 0.01 to 30 $\mu$m. This embodiment prevents the nylon filler being buried in the back surface layer or prevents excessive protrusion of the nylon filler from the back surface layer which enhances the coefficient of friction or causes falling of the filler, so that the contemplated properties on an effective level can be stably attained.

Furthermore, in the thermal transfer image-receiving sheet according to the present invention, the binder of the lubricious back surface layer may be a resin undyable with a sublimable dye. According to this embodiment, the resistance to stain with a sublimable dye can be further improved, and stain of the back surface of the image-receiving sheet with a sublimable dye hardly occurs even when the image-receiving sheets after printing are put on top of one another in such a manner that the surface with an image being formed thereon faced the back surface, and, in this state, are stored.

Example A1

Synthetic paper (Yupo FPG#150 having a thickness of 150 $\mu$m; manufactured by Oji-Yuka Synthetic Paper Co., Ltd.) was used as a substrate sheet, and a coating solution having the following composition for a dye-receptive layer was coated by wire bar coating on one surface of the synthetic paper so that the coverage on a dry basis was 5.0 g/m$^2$, and the resultant coating was dried. A coating solution having the following composition for a dye-unreceptive layer (a back surface layer) was coated on the other surface of the substrate sheet in the same manner as described above so that the coverage on a dry basis was 1.0 g/m$^2$, and the resultant coating was dried, thereby providing a thermal transfer image-receiving sheet of Example A1.

| Composition of coating solution for dye-receptive layer | |
|---|---|
| ① Polyester resin (Vylon 200 manufactured by Toyobo Co., Ltd.) | 100 parts by weight |
| ② Release agent | 5 parts by weight |
| Amino-modified silicone (KF-393 manufactured by The Shin-Etsu Chemical Co., Ltd.) | |
| Epoxy-modified silicone (X-22-343 manufactured by The Shin-Etsu Chemical Co., Ltd.) | 5 parts by weight |
| ③ Solvent (methyl ethyl ketone/toluene; weight ratio = 1:1) | 500 parts by weight |

| Composition of coating solution for dye-unreceptive layer (back surface layer) | |
|---|---|
| ① Polyvinyl alcohol (C-25 manufactured by The Shin-Etsu Chemical Co., Ltd.) | 100 parts by weight |
| ② Chelate compound (Orgatix ZB-110 manufactured by Matsumoto Trading Co., Ltd.) | 25 parts by weight |
| ③ Water | 900 parts by weight |

Example A2

A thermal transfer image-receiving sheet of Example A2 was prepared in the same manner as in Example A1, except that the coating solution for a dye-unreceptive layer (a back surface layer) had the following composition.

| Composition of coating solution for dye-unreceptive layer (back surface layer) | |
|---|---|
| ① Polyvinyl formal (Denka Formal #200 manufactured by Denki Kagaku Kogyo K.K.) | 100 parts by weight |
| ② Release agent | 2 parts by weight |
| Amino-modified silicone (KF-393 manufactured by The Shin-Etsu Chemical Co., Ltd.) | |
| Epoxy-modified silicone (X-22-343 manufactured by The Shin-Etsu Chemical Co., Ltd.) | 2 parts by weight |
| ③ Isocyanate compound Coronate 2030 manufactured by Nippon Polyurethane Industry Co., Ltd. | 300 parts by weight |
| ④ Solvent Isopropyl alcohol/ethyl acetate; weight ratio = 1:1 | 900 parts by weight |

Isopropyl alcohol will be hereinafter referred to as "IPA."

Example A3

A thermal transfer image-receiving sheet of Example A3 was prepared in the same manner as in Example A1, except that the coating solution for a dye-unreceptive layer (a back surface layer) had the following composition.

| Composition of coating solution for dye-unreceptive layer (back surface layer) | |
|---|---|
| ① Polyvinyl butyral (Denka Butyral #2000-L manufactured by Denki Kagaku Kogyo K.K.) | 100 parts by weight |
| ② Release agent Carboxyl-modified silicone (X-22-3710 manufactured by The Shin-Etsu Chemical Co., Ltd.) | 2 parts by weight |
| ③ Chelate compound (Orgatix AI-80 manufactured by Matsumoto Trading Co., Ltd.) | 100 parts by weight |
| ④ Solvent (IPA/ethyl acetate; weight ratio = 1:1) | 900 parts by weight |

Example A4

A thermal transfer image-receiving sheet of Example A4 was prepared in the same manner as in Example A1, except that the coating solution for a dye-unreceptive layer (a back surface layer) had the following composition.

| Composition of coating solution for dye-unreceptive layer (back surface layer) | |
|---|---|
| ① Polyvinyl acetoacetal (KS-1 manufactured by Sekisui Chemical Co., Ltd.) | 100 parts by weight |
| ② Release agent Hydroxy group-modified silicone (X-22-160B manufactured by The Shin-Etsu Chemical Co., Ltd.) | 2 parts by weight |
| ③ Isocyanate compound (Coronate HX manufactured by Nippon Polyurethane Industry Co., Ltd.) | 400 parts by weight |
| ④ Solvent (IPA/ethyl acetate; weight ratio = 1:1) | 900 parts by weight |

Example A5

A thermal transfer image-receiving sheet of Example A5 was prepared in the same manner as in Example A1, except that the coating solution for a dye-unreceptive layer (a back surface layer) had the following composition.

| Composition of coating solution for dye-unreceptive layer (back surface layer) | |
|---|---|
| ① Vinyl chloride/vinyl acetate/polyvinyl alcohol copolymer (Eslec AL manufactured by Sekisui Chemical Co., Ltd.) | 200 parts by weight |
| ② Release agent Amino-modified silicone (KF-393 manufactured by The Shin-Etsu Chemical Co., Ltd.) | 3 parts by weight |
| Epoxy-modified silicone (X-22-343 manufactured by The Shin-Etsu Chemical Co., Ltd.) | 3 parts by weight |
| ③ Chelate compound (Orgatix TC-200 manufactured by Matsumoto Trading Co., Ltd.) | 400 parts by weight |
| ④ Solvent (methyl ethyl ketone/toluene/IPA; weight ratio = 1:1:1) | 800 parts by weight |

Methyl ethyl ketone will be hereinafter referred to as "MEK."

Example A6

A thermal transfer image-receiving sheet of Example A6 was prepared in the same manner as in Example A1, except that the coating solution for a dye-unreceptive layer (a back surface layer) had the following composition.

| Composition of coating solution for dye-unreceptive layer (back surface layer) | |
|---|---|
| ① Vinyl chloride/vinyl acetate copolymer (Denka Vinyl #1000GK manufactured by Denki Kagaku Kogyo K.K.) | 200 parts by weight |
| ② Release agent Amino-modified silicone (KF-393 manufactured by The Shin-Etsu Chemical Co., Ltd.) | 3 parts by weight |
| Epoxy-modified silicone (X-22-343 manufactured by The Shin-Etsu Chemical Co., Ltd.) | 3 parts by weight |
| ③ Isocyanate compound (Coronate L manufactured by Nippon Polyurethane Industry Co., Ltd.) | 300 parts by weight |
| ④ Filler Talc | 400 parts by weight |
| ⑤ Solvent (MEK/toluene; weight ratio = 1:1) | 800 parts by weight |

Example A7

A thermal transfer image-receiving sheet of Example A7 was prepared in the same manner as in Example A1, except that the coating solution for a dye-unreceptive layer (a back surface layer) had the following composition.

| Composition of coating solution for dye-unreceptive layer (back surface layer) | |
|---|---|
| ① Polyvinyl butyral (BX-1 manufactured by Sekisui Chemical Co., Ltd.) | 100 parts by weight |
| ② Release agent Addition-polymerizable silicone (addition-polymerizable silicone B*) | 2 parts by weight |
| Catalyst (PL-50T manufactured by The Shin-Etsu Chemical Co., Ltd.) | 1 part by weight |
| ③ Isocyanate compound (Coronate 2067 manufactured by Nippon Polyurethane Industry Co., Ltd.) | 300 parts by weight |
| ④ Filler Polyethylene wax (SPRAY 30 manufactured by Sasol Co., Ltd.) | 200 parts by weight |
| ⑤ Solvent (IPA/ethyl acetate; weight ratio = 1:1) | 900 parts by weight |

Note:
*Silicone compound represented by the chemical formula 1 or 2, provided that a phenyl group is substituted for 30% of the methyl group

Example A8

A thermal transfer image-receiving sheet of Example A8 was prepared in the same manner as in Example A1, except that the coating solution for a dye-unreceptive layer (a back surface layer) had the following composition.

| Composition of coating solution for dye-unreceptive layer (back surface layer) | |
|---|---|
| ① Polyvinyl butyral (BX-5 manufactured by Sekisui Chemical Co., Ltd.) | 200 parts by weight |
| ② Release agent Addition-polymerizable silicone (addition-polymerizable silicone B) | 2 parts by weight |
| Catalyst (PL-50T manufactured by The Shin-Etsu Chemical Co., Ltd. | 1 part by weight |
| ③ Chelate compound (Orgatix TC-400 manufactured by Matsumoto Trading Co., Ltd.) | 600 parts by weight |
| ④ Filler Nylon 12 filler (MW-330 manufactured by Shinto Paint Co., Ltd.) | 40 parts by weight |
| ⑤ Solvent (MEK/toluene; weight ratio = 1:1) | 800 parts by weight |

Comparative Example A1

A thermal transfer image-receiving sheet of Comparative Example A1 was prepared in the same manner as in Example A1, except that the coating solution for a dye-unreceptive layer (a back surface layer) had the following composition.

| Composition of coating solution for dye-unreceptive layer (back surface layer) | |
|---|---|
| ① Polyvinyl formal (Denka Formal #200 manufactured by Denki Kagaku Kogyo K.K.) | 100 parts by weight |
| ② Solvent (IPA/ethyl acetate; weight ratio = 1:1) | 900 parts by weight |

Comparative Example A2

A thermal transfer image-receiving sheet of Comparative Example A2 was prepared in the same manner as in Example A1, except that the coating solution for a dye-unreceptive layer (a back surface layer) had the following composition.

| Composition of coating solution for dye-unreceptive layer (back surface layer) | |
|---|---|
| ① Polyvinyl butyral (Denka Butyral #2000-L manufactured by Denki Kagaku Kogyo K.K.) | 100 parts by weight |
| ② Solvent (IPA/ethyl acetate; weight ratio = 1:1) | 900 parts by weight |

Comparative Example A3

A thermal transfer image-receiving sheet of Comparative Example A3 was prepared in the same manner as in Example A1, except that the coating solution for a dye-unreceptive layer (a back surface layer) had the following composition.

| Composition of coating solution for dye-unreceptive layer (back surface layer) | |
|---|---|
| ① Vinyl chloride/vinyl acetate copolymer | 200 parts by weight |

-continued

| Composition of coating solution for dye-unreceptive layer (back surface layer) | |
|---|---|
| (Eslec A manufactured by Sekisui Chemical Co., Ltd.) | |
| ② Filler Talc | 400 parts by weight |
| ③ Solvent (MEK/toluene; weight ratio = 1:1) | 800 parts by weight |

Comparative Example A4

A thermal transfer image-receiving sheet of Comparative Example A4 was prepared in the same manner as in Example A1, except that the coating solution for a dye-unreceptive layer (a back surface layer) had the following composition.

| Composition of coating solution for dye-unreceptive layer (back surface layer) | |
|---|---|
| ① Polyvinyl butyral (BX-1 manufactured by Sekisui Chemical Co., Ltd.) | 100 parts by weight |
| ② Filler Polyethylene wax (SPRAY 30 manufactured by Sasol Co., Ltd.) | 200 parts by weight |
| ③ Solvent (IPA/ethyl acetate; weight ratio = 1:1) | 900 parts by weight |

Comparative Example A5

A thermal transfer image-receiving sheet of Comparative Example A5 was prepared in the same manner as in Example A1, except that the coating solution for a dye-unreceptive layer (a back surface layer) had the following composition.

| Composition of coating solution for dye-unreceptive layer (back surface layer) | |
|---|---|
| ① Polyvinyl butyral (BX-5 manufactured by Sekisui Chemical Co., Ltd.) | 200 parts by weight |
| ② Filler Nylon 12 filler (MW-330 manufactured by Shinto Paint Co., Ltd.) | 40 parts by weight |
| ③ Solvent (MEK/toluene; weight ratio = 1:1) | 800 parts by weight |

Example A9

A thermal transfer image-receiving sheet of Example A9 was prepared in the same manner as in Example A1, except that the coating solution for a dye-unreceptive layer (a back surface layer) had the following composition.

| Composition of coating solution for dye-unreceptive layer (back surface layer) | |
|---|---|
| ① Polyvinyl butyral (Denka Butyral #8000-1 manufactured by Denki Kagaku Kogyo K.K.) | 40 parts by weight |
| ② Chelate compound (Tenkarate TP-110 manufactured by Tenkapolymer K.K., Japan) | 30 parts by weight |

-continued

| Composition of coating solution for dye-unreceptive layer (back surface layer) | |
|---|---|
| ③ Solvent (ethyl acetate/IPA; weight ratio = 1:1) | 500 parts by weight |

Comparative Examples A6 and A7

A thermal transfer image-receiving sheet of Comparative Examples A6 and A7 was prepared in the same manner as in Example A1, except that the coating solution for a dye-unreceptive layer (a back surface layer) had the following composition.

| Composition of coating solution for dye-unreceptive layer (back surface layer) | |
|---|---|
| (Comparative Example A6) | |
| ① Polyester resin (Vylon 200 manufactured by Toyobo Co., Ltd.) | 100 parts by weight |
| ② Isocyanate compound (Takenate A-14 manufactured by Takeda Chemical Industries, Ltd.) | 20 parts by weight |
| ③ Solvent (methyl ethyl ketone/toluene; weight ratio = 1:1) | 400 parts by weight |
| (Comparative Example A7) | |
| ① Polyester resin (Vylon 600 manufactured by Toyobo Co., Ltd.) | 100 parts by weight |
| 2 Chelate compound (Orgatix TC-400 manufactured by Matsumoto Trading Co., Ltd.) | 150 parts by weight |
| ③ Solvent (methyl ethyl ketone/toluene; weight ratio = 1:1) | 400 parts by weight |

Thus, the thermal transfer image-receiving sheets of Examples Al to A9 of the present invention and Comparative Examples A1 to A7 were prepared. The following thermal transfer sheet was prepared as a thermal transfer sheet sample for use in a test for the evaluation of the performance of these thermal transfer image-receiving sheets in which test the thermal transfer image-receiving sheets were actually fed into a printer to form an image.

(Preparation of thermal transfer sheet)

A 6 μm-thick polyethylene terephthalate film having a back surface subjected to a treatment for rendering the surface heat-resistant was provided as a substrate sheet for a thermal transfer sheet, and an ink having the following composition for the formation of a thermal transfer layer was coated on the film in its surface not subjected to the treatment for rendering the surface heat-resistant by wire bar coating at a coverage on a dry basis of 1.0 g/m$^2$. The resultant coating was dried to provide a thermal transfer sheet sample.

| Composition of ink for thermal transfer layer | |
|---|---|
| ① Cyan dye (Kayaset Blue 714, C.I. SOLVENT BLUE 63, manufactured by Nippon Kayaku Co., Ltd.) | 40 parts by weight |
| ② Polyvinyl butyral (Eslec BX-1 manufactured by Sekisui Chemical Co., Ltd.) | 30 parts by weight |
| ③ Solvent (MEK/toluene; weight ratio = 1:1) | 530 parts by weight |

(Test and results)

The above thermal transfer sheet was used in combination with the thermal transfer image-receiving sheets of Examples A1 to A8 and Comparative Examples A1 to A5 to carry out a test for the following items, and the results are given in Table A1.

1) Releasability of back surface of image-receiving sheet (test on abnormal dye transfer to back surface of image-receiving sheet)

The above-described thermal transfer sheet and the thermal transfer image-receiving sheets of Examples A1 to A8 and Comparative Examples A1 to A5 were put on top of the other in such a manner that the surface coated with an transfer ink of the thermal transfer sheet faced the surface of the dye-unreceptive layer (back surface) of the thermal transfer image-receiving sheet. A cyan image was recorded by means of a thermal head from the back surface (the surface which had been subjected to a treatment for rendering the surface heat-resistant) of the thermal transfer sheet under conditions of an applied voltage of 11 V, a step pattern in which the applied pulse width was successively reduced from 16 msec/line every 1 msec, and 6 lines/mm (33.3 msec/line) in the sub-scanning direction, and the releasability of the thermal transfer sheet from the back surface of the image-receiving sheet was observed.

Criteria for evaluation:

O: Good releasability

X: Poor releasability (occurrence of the capture of the ink layer of the thermal transfer sheet due to fusing or the like, the capture of the back surface layer of the image-receiving sheet, and other unfavorable phenomena)

2) Stain resistance of back surface of image-receiving sheet

The above-described thermal transfer sheet and the thermal transfer image-receiving sheets of Examples A1 to A9 and Comparative Examples A1 to A7 were put on top of the other in such a manner that the surface coated with an transfer ink of the thermal transfer sheet faced the surface of the dye-receptive layer of the thermal transfer image-receiving sheet. A cyan image was formed on the surface of the dye-receptive layer in each image-receiving sheet by means of a thermal head from the back surface (the surface which had been subjected to a treatment for rendering the surface heat-resistant) of the thermal transfer sheet under conditions of an applied voltage of 11 V, a step pattern in which the applied pulse width was successively reduced from 8 msec/line every 0.5 msec, and 6 lines/mm (16 msec/line) in the sub-scanning direction. Thereafter, for each sample of Examples A1 to A8 and Comparative Examples A1 to A7 on which an cyan image had been formed, 10 sample sheets were put on top of another in such a manner that the surface with an image being formed thereon faced the surface of the dye-unreceptive layer (back surface). A smooth aluminum plate was put on each of the uppermost sheet and the lowermost sheet to sandwich the sample sheets between the aluminum plates. A load of 20 g·f/cm$^2$ was applied to the assembly from the top thereof. In this state, the assembly was allowed to stand in. a constant-temperature oven at 50° C. for 7 days. The migration of the dye of each sample to the back surface was visually inspected.

Criteria for evaluation

A: Little or no dye migration observed.

B: Dye migration observed with no clear step pattern being observed.

C: Dye migration observed with clear step pattern being observed.

TABLE A1

| Sample under test | Releasability of back surface of image-receiving sheet | Stain resistance of back surface of image-receiving sheet | Overall evaluation |
|---|---|---|---|
| Ex. A1 | x | A | Good |
| Ex. A2 | ○ | A | Good |
| Ex. A3 | ○ | A | Good |
| Ex. A4 | ○ | A | Good |
| Ex. A5 | ○ | A | Good |
| Ex. A6 | ○ | A | Good |
| Ex. A7 | ○ | A | Good |
| Ex. A8 | ○ | A | Good |
| Ex. A9 | x | A | Good |
| Comp. Ex. A1 | x | B | Poor |
| Comp. Ex. A2 | x | B | Poor |
| Comp. Ex. A3 | x | C | Poor |
| Comp. Ex. A4 | x | B | Poor |
| Comp. Ex. A5 | x | B | Poor |
| Comp. Ex. A6 | x | B | Poor |
| Comp. Ex. A7 | x | C | Poor |

The thermal transfer image-receiving sheet according to the first aspect of the present invention comprises a substrate sheet, a dye-receptive layer provided on one surface of said substrate sheet and a dye-unreceptive layer provided on the other surface of said substrate sheet, the dye-unreceptive layer comprising a composition composed mainly of at least one thermoplastic resin having at least one reactive functional group and an isocyanate compound or a chelate compound. The adoption of such a constitution brings the thermoplastic resin of the dye-unreceptive layer as a back surface layer of the image-receiving sheet to a crosslinked structure, which contributes to an improvement in heat resistance and a lowering in receptivity to a sublimable dye. This improves the suitability of the image-receiving sheet for automatic feed and delivery in a printer, and the stain of the back surface with a sublimable dye can be reduced even when a plurality of sheets are stored with the surface of the print facing the back surface.

Further, in the thermal transfer image-receiving sheet according to the first aspect of the present invention, the thermoplastic resin of the dye-unreceptive layer as the back surface may be a thermoplastic resin having a hydroxyl group as the reactive functional group, more specifically, polyvinyl formal, polyvinyl acetoacetal or polyvinyl butyral. This embodiment enables the thermoplastic resin to be more surely reacted with the isocyanate compound or chelate compound, so that the above effect can be attained more efficiently and stably.

Furthermore, in the thermal transfer image-receiving sheet according to the first aspect of the present invention, the dye-unreceptive layer provided in the back surface may further comprise an organic filler and/or an inorganic filler or a release agent, or an organic filler and/or an inorganic filler and a release agent. According to this embodiment, in addition to the above effect, a further improvement in releasability and slidability of the back surface of the thermal transfer image-receiving sheet can be attained. Further, since the release agent is fixed to the dye-unreceptive layer, it is not transferred to other places. Therefore, the suitability of the thermal transfer image-receiving sheet for automatic feed and delivery and the carriability in a printer can be further improved, so that the printing operation becomes stable. Furthermore, even though the thermal transfer sheet is fed into a printer with the back surface and the image-receiving surface of the image-receiving sheet being inversive and, in this state, printing is carried out, the sheet can be successfully delivered from the printer without the occurrence of heat fusing or sticking between the thermal transfer sheet and the back surface of the image-receiving sheet by heat. Furthermore, a further improvement in stain resistance of the back surface of the image-receiving sheet in the case of storage of a plurality of sheets with the surface of the print facing the back surface of the sheet can be attained.

Thus, according to the first aspect of the present invention, a thermal transfer image-receiving sheet having a very excellent handleability can be easily provided.

Example B1

Synthetic paper (Yupo FPG#150 having a thickness of 150 μm; manufactured by Oji-Yuka Synthetic Paper Co., Ltd.) was used as a substrate sheet, and a coating solution having the following composition for a dye-receptive layer was coated by wire bar coating on one surface of the synthetic paper so that the coverage on a dry basis was 5.0 g/m$^2$, and the resultant coating was dried. Subsequently, a coating solution (heated to 80° C. for dissolution) having the following composition for a dye-unreceptive layer (a back surface layer) was coated on the other surface of the substrate sheet by means of a heated wire bar at a coverage on a dry basis of 1.0 g/m$^2$, and the resultant coating was cooled, thereby providing a thermal transfer image-receiving sheet of Example B1.

| Composition of coating solution for dye-receiving layer | |
|---|---|
| ① Vinyl chloride/vinyl acetate copolymer resin (Denkalac #1000A manufactured by Denki Kagaku Kogyo K.K.) | 100 parts by weight |
| ② Release agent (Epoxy-modified silicone: X-22-163B manufactured by The Shin-Etsu Chemical Co., Ltd.) | 10 parts by weight |
| ③ Solvent (methyl ethyl ketone/toluene; weight ratio = 1:1) | 500 parts by weight |

Methyl ethyl ketone will be hereinafter referred to as "MEK."

| Composition of coating solution for dye-unreceptive layer (back surface layer) | |
|---|---|
| ① Paraffin wax (HNP-11 manufactured by Nippon Seiro Co., Ltd.) (melt coating) | 100 parts by weight |

Example B2

A thermal transfer image-receiving sheet of Example B2 was prepared in the same manner as in Example B1, except that the coating solution having the following composition for a dye-unreceptive layer (a back surface layer) was used instead of the coating solution used in Example B1 and the coating solution was coated by wire bar coating to form a coating which was then dried.

| Composition of coating solution for dye-unreceptive layer (back surface layer) | |
|---|---|
| ① Vinyl chloride/vinyl acetate copolymer resin (Denkalac #1000MT manufactured by Denki Kagaku Kogyo K.K.) | 100 parts by weight |
| ② Release agent (Epoxy-modified silicone: X-22-163B manufactured by The Shin-Etsu Chemical Co., Ltd.) | 5 parts by weight |
| ③ Solvent (MEK/toluene; weight ratio = 1:1) | 500 parts by weight |

Example B3

A thermal transfer image-receiving sheet of Example B3 was prepared in the same manner as in Example B1, except that the coating solution having the following composition for a dye-unreceptive layer (a back surface layer) was used instead of the coating solution used in Example B1 and the coating solution was coated by wire bar coating to form a coating which was then dried.

| Composition of coating solution for dye-unreceptive layer (back surface layer) | |
|---|---|
| ① Amino-modified silicone (KF-393 manufactured by The Shin-Etsu Chemical Co., Ltd.) | 10 parts by weight |
| ② Epoxy-modified silicone (X-22-343 manufactured by The Shin-Etsu Chemical Co., Ltd.) | 10 parts by weight |
| ③ Solvent (MEK/toluene; weight ratio = 1:1) | 80 parts by weight |

Example B4

A thermal transfer image-receiving sheet of Example B4 was prepared in the same manner as in Example B1, except that the coating solution having the following composition for a dye-unreceptive layer (a back surface layer) was used instead of the coating solution used in Example B1 and the coating solution was coated by wire bar coating to form a coating which was then dried.

| Composition of coating solution for dye-unreceptive layer (back surface layer) | |
|---|---|
| ① Release agent (Addition-polymerizable silicone KS835 manufactured by The Shin-Etsu Chemical Co., Ltd.) | 20 parts by weight |
| ② Catalyst (CAT-PL-8 manufactured by The Shin-Etsu Chemical Co., Ltd.) | 8 parts by weight |
| ③ Solvent (MEK/toluene; weight ratio = 1:1) | 80 parts by weight |

Example B5

A thermal transfer image-receiving sheet of Example B5 was prepared in the same manner as in Example B1, except that the coating solution having the following composition for a dye-unreceptive layer (a back surface layer) was used instead of the coating solution used in Example B1 and the coating solution was coated by wire bar coating to form a coating which was then dried.

| Composition of coating solution for dye-unreceptive layer (back surface layer) | |
|---|---|
| ① Release agent (Addition-polymerizable silicone KS779H manufactured by The Shin-Etsu Chemical Co., Ltd.) | 20 parts by weight |
| ② Catalyst (CAT-PL-8 manufactured by The Shin-Etsu Chemical Co., Ltd.) | 8 parts by weight |
| ③ Solvent (MEK/toluene; weight ratio = 1:1) | 80 parts by weight |

Example B6

A thermal transfer image-receiving sheet of Example B6 was prepared in the same manner as in Example B1, except that the coating solution having the following composition for a dye-unreceptive layer (a back surface layer) was used instead of the coating solution used in Example B1 and the coating solution was coated by wire bar coating to form a coating which was then dried.

| Composition of coating solution for dye-unreceptive layer (back surface layer) | |
|---|---|
| ① Release agent (Addition-polymerizable silicone KS774 manufactured by The Shin-Etsu Chemical Co., Ltd.) | 20 parts by weight |
| ② Catalyst (CAT-PL-4 manufactured by The Shin-Etsu Chemical Co., Ltd.) | 8 parts by weight |
| ③ Solvent (MEK/toluene; weight ratio = 1:1) | 80 parts by weight |

Example B7

A thermal transfer image-receiving sheet of Example B7 was prepared in the same manner as in Example B1, except that the coating solution having the following composition for a dye-unreceptive layer (a back surface layer) was used instead of the coating solution used in Example B1 and the coating solution was coated by wire bar coating to form a coating which was then dried.

| Composition of coating solution for dye-unreceptive layer (back surface layer) | |
|---|---|
| ① Release agent (Condensation-polymerizable silicone KS705F manufactured by The Shin-Etsu Chemical Co., Ltd.) | 20 parts by weight |
| ② Catalyst (CAT-PS-1 manufactured by The Shin-Etsu Chemical Co., Ltd.) | 10 parts by weight |
| ③ Solvent (toluene) | 80 parts by weight |

Example B8

A thermal transfer image-receiving sheet of Example B8 was prepared in the same manner as in Example B1, except that the coating solution having the following composition for a dye-unreceptive layer (a back surface layer) was used instead of the coating solution used in Example B1 and the coating solution was coated by wire bar coating to form a coating which was then dried.

| Composition of coating solution for dye-unreceptive layer (back surface layer) | |
|---|---|
| ① Acrylic resin (BR-80 manufactured by Mitsubishi Rayon Co., Ltd.) | 20 parts by weight |
| ② Amino-modified silicone (KF-393 manufactured by The Shin-Etsu Chemical Co., Ltd.) | 2 parts by weight |
| ③ Epoxy-modified silicone (X-22-343 manufactured by The Shin-Etsu Chemical Co., Ltd.) | 2 parts by weight |
| ④ Solvent (MEK/toluene; weight ratio = 1:1) | 80 parts by weight |

Example B9

A thermal transfer image-receiving sheet of Example B9 was prepared in the same manner as in Example B1, except that the coating solution having the following composition for a dye-unreceptive layer (a back surface layer) was used instead of the coating solution for the back surface layer used in Example B1 and the coating solution was coated by wire bar coating to form a coating which was then dried and irradiated with ultraviolet rays by means of a xenon lamp at a distance of 20 cm for 5 sec.

| Composition of coating solution for dye-unreceptive layer (back surface layer) | |
|---|---|
| ① Cellulosic resin (CAB manufactured by Kodac Co.) | 200 parts by weight |
| ② Radical-polymerizable silicone (X-22-500 manufactured by The Shin-Etsu Chemical Co., Ltd.) | 20 parts by weight |
| ③ Acrylic acid monomer | 10 parts by weight |
| ④ Photopolymerization initiator (benzoin methyl ether) | 2 parts by weight |
| ⑤ Solvent (MEK/toluene; weight ratio = 1:1) | 800 parts by weight |

Example B10

A thermal transfer image-receiving sheet of Example B10 was prepared in the same manner as in Example B1, except that the coating solution having the following composition for a dye-unreceptive layer (a back surface layer) was used instead of the coating solution used in Example B1 and the coating solution was coated by wire bar coating to form a coating which was then dried.

| Composition of coating solution for dye-unreceptive layer (back surface layer) | |
|---|---|
| ① Polycarbonate resin (Z-400 manufactured by Mitsubishi Gas Chemical Co., Inc.) | 20 parts by weight |
| ② Carboxyl-modified silicone (X-22-3701E manufactured by The Shin-Etsu Chemical Co., Ltd.) | 2 parts by weight |
| ③ Chelate compound | 1 part by weight |

-continued

| Composition of coating solution for dye-unreceptive layer (back surface layer) | |
|---|---|
| (Orgatix TC-200 manufactured by Matsumoto Trading Co., Ltd.) | |
| ④ Filler Talc | 40 parts by weight |
| ⑤ Solvent (MEK/toluene; weight ratio = 1:1) | 80 parts by weight |

Example B11

A thermal transfer image-receiving sheet of Example B11 was prepared in the same manner as in Example B1, except that the coating solution having the following composition for a dye-unreceptive layer (a back surface layer) was used instead of the coating solution used in Example B1 and the coating solution was coated by wire bar coating to form a coating which was then dried.

| Composition of coating solution for dye-unreceptive layer (back surface layer) | |
|---|---|
| ① Butyral resin (BX-1 manufactured by Sekisui Chemical Co., Ltd.) | 20 parts by weight |
| ② Hydroxyl group-modified silicone (X-22-160AS manufactured by The Shin-Etsu Chemical Co., Ltd.) | 3 parts by weight |
| ③ Isocyanate compound (Takenate XA14 manufactured by Takeda Chemical Industries, Ltd.) | 3 parts by weight |
| ④ Filler Polyethylene wax (SPRAY 30 manufactured by Sasol Co., Ltd.) | 20 parts by weight |
| ⑤ Solvent (MEK/toluene; weight ratio = 1:1) | 80 parts by weight |

Example B12

A thermal transfer image-receiving sheet of Example B12 was prepared in the same manner as in Example B1, except that the coating solution having the following composition for a dye-unreceptive layer (a back surface layer) was used instead of the coating solution used in Example B1 and the coating solution was coated by wire bar coating to form a coating which was then dried.

| Composition of coating solution for dye-unreceptive layer (back surface layer) | |
|---|---|
| ① Butyral resin (BX-1 manufactured by Sekisui Chemical Co., Ltd.) | 20 parts by weight |
| ② Release agent (addition-polymerizable silicone A) | 2 parts by weight |
| ③ Catalyst (CAT-PL-50T manufactured by The Shin-Etsu Chemical Co., Ltd.) | 1 part by weight |
| ④ Filler Nylon 12 filler (MW-330 manufactured by Shinto Paint Co., Ltd.) | 4 parts by weight |

-continued

| Composition of coating solution for dye-unreceptive layer (back surface layer) | |
|---|---|
| ⑤ Solvent (MBK/toluene; weight ratio = 1:1) | 80 parts by weight |

Addition-polymerizable silicone A is a silicone represented by the chemical formula 1 or 2, provided that a phenyl group is substituted for 50% of the methyl group.

Example B13

Synthetic paper (Yupo FPG#150 having a thickness of 150 μm; manufactured by Oji-Yuka Synthetic Paper Co., Ltd.) was used as a substrate sheet, and a coating solution having the following composition for a dye-receptive layer was coated by wire bar coating on one surface of the synthetic paper so that the coverage on a dry basis was 5.0 g/m$^2$, and the resultant coating was dried. Subsequently, a coating solution having the following composition for a dye-unreceptive layer (a back surface layer) was coated on the other surface of the substrate sheet by means of a wire bar so that the coverage on a dry basis was 1.0 g/m$^2$, and the resultant coating was dried, thereby providing a thermal transfer image-receiving sheet of Example B13.

| Composition of coating solution for dye-receptive layer | |
|---|---|
| ① Polyester (Vylon 200 manufactured by Toyobo Co., Ltd.) | 100 parts by weight |
| ② Release agent (addition-polymerizable silicone A) | 10 parts by weight |
| ③ Catalyst (CAT-PL-50T manufactured by The Shin-Etsu Chemical Co., Ltd.) | 5 parts by weight |
| ④ Reaction inhibitor (CAT-PLR-5 manufactured by The Shin-Etsu Chemical Co., Ltd.) | 5 parts by weight |
| ⑤ Solvent (MEK/toluene; weight ratio = 1:1) | 500 parts by weight |

| Composition of coating solution for dye-unreceptive layer (back surface layer) | |
|---|---|
| ① Butyral resin (Denka butyral #3000-1 manufactured by Denki Kagaku Kogyo K.K) | 26 parts by weight |
| ② Chelate compound (Orgatix TC-100 manufactured by Matsumoto Trading Co., Ltd.) | 20 parts by weight |
| ③ Release agent (addition-polymerizable silicone A) | 2 parts by weight |
| ④ Catalyst (PL-50T manufactured by The Shin-Etsu Chemical Co., Ltd.) | 1 part by weight |
| ⑤ Reaction inhibitor (PLR-5 manufactured by The Shin-Etsu Chemical Co., Ltd.) | 1 part by weight |
| ⑥ Filler Nylon 12 filler (MW-330 manufactured by Shinto Paint Co., Ltd.) | 6 parts by weight |

-continued

| Composition of coating solution for dye-unreceptive layer (back surface layer) | |
|---|---|
| ⑦ Solvent (isopropyl alcohol/toluene; weight ratio = 1:1) | 200 parts by weight |

Isopropyl alcohol will be hereinafter referred to as "IPA."

Example B14

A thermal transfer image-receiving sheet of Example B14 was prepared in the same manner as in Example B13, except that the coating solution for a dye-unreceptive layer (a back surface layer) had the following composition.

| Composition of coating solution for dye-unreceptive layer (back surface layer) | |
|---|---|
| ① Vinyl chloride/vinyl acetate copolymer resin (Denkalac #1000MT manufactured by Denki Kagaku Kogyo K.K) | 20 parts by weight |
| ② Amino-modified silicone (KF-393 manufactured by The Shin-Etsu Chemical Co., Ltd.) | 2 parts by weight |
| ③ Epoxy-modified silicone (X-22-343 manufactured by The Shin-Etsu Chemical Co., Ltd.) | 2 parts by weight |
| ④ Solvent (MEK/toluene; weight ratio = 1:1) | 80 parts by weight |

Example B15

Synthetic paper (Yupo FPG#150 having a thickness of 150 μm; manufactured by Oji-Yuka Synthetic Paper Co., Ltd.) was used as a substrate sheet, and a coating solution having the following composition for a dye-receptive layer was coated by wire bar coating on one surface of the synthetic paper so that the coverage on a dry basis was 5.0 g/m$^2$, and the resultant coating was dried. Subsequently, a coating solution having the following composition for a dye-unreceptive layer (a back surface layer) was coated on the other surface of the substrate sheet by means of a wire bar so that the coverage on a dry basis was 1.0 g/m$^2$, and the resultant coating was dried, thereby providing a thermal transfer image-receiving sheet of Example B15.

| Composition of coating solution for dye-receptive layer | |
|---|---|
| ① Vinyl chloride/vinyl acetate copolymer resin (Denkalac #1000A manufactured by Denki Kagaku Kogyo K.K) | 45 parts by weight |
| ② Styrene-modified vinyl chloride/acrylic copolymer resin (Denkalac #400 manufactured by Denki Kagaku Kogyo K.K) | 45 parts by weight |
| ③ Polyester resin (Vylon 600 manufactured by Toyobo Co., Ltd.) | 10 parts by weight |
| ④ Release agent (addition-polymerizable silicone A) | 10 parts by weight |
| ⑤ Catalyst (CAT-PL-50T manufactured by The Shin-Etsu Chemical Co., Ltd.) | 5 parts by weight |

-continued

| Composition of coating solution for dye-receptive layer | |
|---|---|
| ⑥ Solvent (MEK/toluene; weight ratio = 1:1) | 500 parts by weight |

| Composition of coating solution for dye-unreceptive layer (back surface layer) | |
|---|---|
| ① Butyral resin (Denka Butyral #3000-1 manufactured by Denki Kagaku Kogyo K.K) | 26 parts by weight |
| ② Chelate compound (Orgatix TC-100 manufactured by Matsumoto Trading Co., Ltd.) | 20 parts by weight |
| ③ Release agent (addition-polymerizable silicone A) | 2 parts by weight |
| ④ Catalyst (PL-50T manufactured by The Shin-Etsu Chemical Co., Ltd.) | 1 part by weight |
| ⑤ Reaction inhibitor (PLR-5 manufactured by The Shin-Etsu Chemical Co., Ltd.) | 1 part by weight |
| ⑥ Filler Nylon 12 filler (MW-330 manufactured by Shinto Paint Co., Ltd.) | 6 parts by weight |
| ⑦ Solvent (IPA/toluene; weight ratio = 1:1) | 200 parts by weight |

Example B16

In the present example, a thermal transfer image-receiving sheet was constructed so that the image-receiving sheet after recording an image thereon can be used in applications such as sealing labels. For this purpose, in the construction of Example B13, the substrate sheet used in Example B13 was changed to a laminate sheet having the following construction. The surface of the laminate sheet was coated with a coating solution having the following composition for a dye-receptive layer instead of the coating solution for a dye-receptive layer used in Example B13. The back surface of the laminate sheet was coated with a urethane primer, and a coating solution having the following composition for a dye-unreceptive layer was then coated on the primer coating. The coating method, coverage and other conditions for coating of the coating solution for a dye-receptive layer and the coating solution for a dye-unreceptive layer were the same as those used in Example B13. Thus, a thermal transfer image-receiving sheet of Example B16 for a sealing label was prepared.

Construction of substrate laminate sheet

A laminate sheet used as a substrate sheet comprised a 50 μm-thick polyethylene terephthalate foam sheet (white) (W900J manufactured by Diafoil Co., Ltd.) as a substrate material and a releasable sheet [a polyethylene terephthalate film having one surface which has been subjected to a treatment for rendering the surface releasable (MRW900E having a thickness of 100 μm, manufactured by Diafoil Co., Ltd.] releasably laminated on one surface of the foam sheet through an acrylic sticking agent layer.

| Composition of coating solution for dye-receptive layer | |
|---|---|
| ① Polyester resin (Vylon 600 manufactured by Toyobo Co., Ltd.) | 40 parts by weight |
| ② Vinyl chloride/vinyl acetate copolymer (Denkalac #1000A manufactured by Denki Kagaku Kogyo K.K) | 60 parts by weight |
| ③ Amino-modified silicone (X-22-3050C manufactured by The Shin-Etsu Chemical Co., Ltd.) | 2 parts by weight |
| ④ Epoxy-modified silicone (X-22-3000E manufactured by The Shin-Etsu Chemical Co., Ltd.) | 2 parts by weight |
| ⑤ Solvent (MEK/toluene; weight ratio = 1:1) | 400 parts by weight |

| Composition of coating solution for dye-unreceptive layer (back surface layer) | |
|---|---|
| ① Butyral resin (Denka Butyral #3000-1 manufactured by Denki Kagaku Kogyo K.K) | 26 parts by weight |
| ② Chelate compound (Orgatix TC-100 manufactured by Matsumoto Trading Co., Ltd.) | 20 parts by weight |
| ③ Release agent (addition polymerizable silicone A) | 2 parts by weight |
| ④ Catalyst (CAT-PL-50T manufactured by The Shin-Etsu Chemical Co., Ltd.) | 1 part by weight |
| ⑤ Reaction inhibitor (CAT-PLR-5 manufactured by The Shin-Etsu Chemical Co., Ltd.) | 1 part by weight |
| ⑥ Filler Nylon 12 filler (MW-330 manufactured by Shinto Paint Co., Ltd.) | 6 parts by weight |
| ⑦ Solvent (MEK/toluene; weight ratio = 1:1) | 200 parts by weight |

Examples B17 and B18

Thermal transfer image-receiving sheets of Examples B17 and B18 were prepared in the same manner as in Example B13, except that the coating solution for a dye-unreceptive layer had the following composition.

| (Example 17) | |
|---|---|
| ① Butyral resin (Denka Butyral #3000-1 manufactured by Denki Kagaku Kogyo K.K) | 40 parts by weight |
| ② Chelate compound (Tenkarate TP-110 manufactured by Tenkapolymer K.K., Japan) | 30 parts by weight |
| ③ Release agent (addition polymerizable silicone B*) | 3 parts by weight |
| ④ Catalyst (PL-50T manufactured by The Shin-Etsu Chemical Co., Ltd.) | 1.5 parts by weight |
| ⑤ Reaction inhibitor (PLR-5 manufactured by The Shin-Etsu Chemical Co., Ltd.) | 1.5 parts by weight |
| ⑥ Filler Nylon 12 filler | 8 parts by weight |

-continued

| (Example 17) | |
|---|---|
| (MW-330 manufactured by Shinto Paint Co., Ltd.) | |
| ⑦ Solvent (ethyl acetate/IPA = 1/1) | 500 parts by weight |

Addition-polymerizable silicone B is a silicone compound represented by the chemical formula 1 or 2, provided that a phenyl group is substituted for 30% of the methyl group.

| (Example 18) | |
|---|---|
| ① Acrylic resin (BR-85 manufactured by Mitsubishi Rayon Co.,) | 20 parts by weight |
| ② Ethyl hydroxy ethyl cellulose resin (EHEC (Low) manufactured by Hercules Inc.) | 3 parts by weight |
| ③ Release agent (Addition polymerizable silicone B) | 2 parts by weight |
| ④ Catalyst (PL-50T manufactured by The Shin-Etsu Chemical Co., Ltd.) | 1 part by weight |
| ⑤ Reaction inhibitor (PLR-5 manufactured by The Shin-Etsu Chemical Co., Ltd.) | 1 part by weight |
| ⑥ Filler Teflon filler (Ruburon L5 manufactured by Daikin Industries, Ltd.) | 15 parts by weight |
| ⑦ Solvent (MEK/toluene = 1/1) | 160 parts by weight |

Comparative Example B1

A thermal transfer image-receiving sheet of Comparative Example B1 was prepared in the same manner as in Example B1, except that the coating solution for a dye-unreceptive layer (a back surface layer) had the following composition and the coating solution was coated by wire bar coating to form a coating which was then dried.

| Composition of coating solution for dye-unreceptive layer (back surface layer) | |
|---|---|
| ① Vinyl chloride/vinyl acetate copolymer (Denkalac #1000A manufactured by Denki Kagaku Kogyo K.K) | 20 parts by weight |
| ② Solvent (MEK/toluene; weight ratio = 1:1) | 80 parts by weight |

Comparative Example B2

A thermal transfer image-receiving sheet of Comparative Example B2 was prepared in the same manner as in Example B1, except that the coating solution for a dye-unreceptive layer (a back surface layer) had the following composition and the coating solution was coated by wire bar coating to form a coating which was then dried.

| Composition of coating solution for dye-unreceptive layer (back surface layer) | |
|---|---|
| ① Polycarbonate resin (Z-400 manufactured by Mitsubishi Gas Chemical Co., Inc.) | 20 parts by weight |
| ② Filler Talc | 40 parts by weight |
| ③ Solvent (MEK/toluene; weight ratio = 1:1) | 80 parts by weight |

Comparative Example B3

A thermal transfer image-receiving sheet of Comparative Example B3 was prepared in the same manner as in Example B1, except that the coating solution for a dye-unreceptive layer (a back surface layer) had the following composition and the coating solution was coated by wire bar coating to form a coating which was then dried.

| Composition of coating solution for dye-unreceptive layer (back surface layer) | |
|---|---|
| ① Polyester resin (Vylon #600 manufactured by Toyobo Co., Ltd.) | 20 parts by weight |
| ② Filler Polyethylene wax (SPRAY 30 manufactured by Sasol Co., Ltd.) | 20 parts by weight |
| ③ Solvent (MEK/toluene; weight ratio = 1:1) | 80 parts by weight |

Comparative Example B4

A thermal transfer image-receiving sheet of Comparative Example B4 was prepared in the same manner as in Example B1, except that the coating solution for a dye-unreceptive layer (a back surface layer) had the following composition and the coating solution was coated by wire bar coating to form a coating which was then dried.

| Composition of coating solution for dye-unreceptive layer (back surface layer) | |
|---|---|
| ① Butyral resin (BX-1 manufactured by Sekisui Chemical Co., Ltd.) | 26 parts by weight |
| ② Chelate compound (Orgatix TC-100 manufactured by Matsumoto Trading Co., Ltd.) | 20 parts by weight |
| ③ Filler Nylon 12 filler (MW-330 manufactured by Shinto Paint Co., Ltd.) | 6 parts by weight |
| ④ Solvent (MEK/toluene; weight ratio = 1:1) | 200 parts by weight |

Thus, the following thermal transfer sheet was prepared for use in a test for the evaluation of the performance of the thermal transfer image-receiving sheets of Examples B1 to B8 of the present invention and Comparative Examples B1 to B4, in which test the thermal transfer image-receiving sheets were actually fed into a printer to form an image.

(Preparation of thermal transfer sheet)

A 6 μm-thick polyethylene terephthalate film having a back surface subjected to a treatment for rendering the surface heat-resistant was provided as a substrate sheet for a thermal transfer sheet, and an ink having the following composition for the formation of a thermal transfer layer was coated on the film in its surface not subjected to the treatment for rendering the surface heat-resistant by wire bar coating at a coverage on a dry basis of 1.0 g/m$^2$. The resultant coating was dried to provide a thermal transfer sheet sample.

| Composition of ink for thermal transfer layer | |
|---|---|
| ① Cyan dye (Kayaset Blue 714, C.I. SOLVENT BLUE 63, manufactured by Nippon Kayaku Co., Ltd.) | 40 parts by weight |
| ② Polyvinyl butyral (Eslec BX-1 manufactured by Sekisui Chemical Co., Ltd.) | 30 parts by weight |
| ③ Solvent (MEK/toluene; weight ratio = 1:1) | 530 parts by weight |

(Test and results)

The above thermal transfer sheet was used in combination with the thermal transfer image-receiving sheets of Examples B1 to B18 and Comparative Examples B1 to B4 to carry out a test for the following items, and the results are given in Table B1.

1) Releasability of back surface of image-receiving sheet (test on abnormal transfer to back surface of image-receiving sheet)

The above-described thermal transfer sheet and the thermal transfer image-receiving sheets of Examples B1 to B18 and Comparative Examples B1 to B4 were put on top of the other in such a manner that the surface coated with an transfer ink of the thermal transfer sheet faced the surface of the dye-unreceptive layer (back surface) of the thermal transfer image-receiving sheet. A cyan image was recorded by means of a thermal head from the back surface (the surface which had been subjected to a treatment for rendering the surface heat-resistant) of the thermal transfer sheet under conditions of an applied voltage of 11 V, a step pattern in which the applied pulse width was successively reduced from 16 msec/line every 1 msec, and 6 lines/mm (33.3 msec/line) in the sub-scanning direction, and the releasability of the thermal transfer sheet from the back surface of the image-receiving sheet was observed.

Criteria for evaluation;

O: Good releasability

X: Poor releasability (occurrence of the capture of the ink layer of the thermal transfer sheet due to fusing or the like, the capture of the back surface layer of the image-receiving sheet, and other unfavorable phenomena)

2) Stain resistance of back surface of image-receiving sheet

The above-described thermal transfer sheet and the thermal transfer image-receiving sheets of Examples B1 to B18 and Comparative Examples B1 to B4 were put on top of the other in such a manner that the surface coated with an transfer ink of the thermal transfer sheet faced the surface of the dye-receptive layer of the thermal transfer image-receiving sheet. A cyan image was formed on the surface of the dye-receptive layer in each image-receiving sheet by means of a thermal head from the back surface (the surface which had been subjected to a treatment for rendering the surface heat-resistant) of the thermal transfer sheet under conditions of an applied voltage of 11 V, a step pattern in which the applied pulse width was successively reduced from 16 msec/line every 1 msec, and 6 lines/mm (33.3 msec/line) in the sub-scanning direction. Thereafter, for each sample of Examples B1 to B18 and Comparative Examples B1 to B4 on which an cyan image had been formed, 10 sample sheets were put on top of one another in such a manner that the surface with an image being formed thereon faced the surface of the dye-unreceptive layer (back surface). A smooth aluminum plate was put on each of the uppermost sheet and the lowermost sheet to sandwich the sample sheets between the aluminum plates. A load of 20 g·f/cm$^2$ was applied to the assembly from the top thereof. In this state, the assembly was allowed to stand in a constant-temperature oven at 50° C. for 7 days. The migration of the dye of each sample to the back surface was visually inspected.

Criteria for evaluation

A: Little or no dye migration observed.

B: Dye migration observed with no clear step pattern being observed.

C: Dye migration observed with clear step pattern being observed.

3) Unevenness on the printed face of the image-receiving sheet (influence of components of the back surface layer on the receptive layer)

For each sample of Examples Bl to B18 and Comparative Examples B1 to B4, 10 sample sheets were put on top of one another in such a manner that the surface with an image being formed thereon faced the surface of the dye-unreceptive layer (back surface). A smooth aluminum plate was put on each of the uppermost sheet and the lowermost sheet to sandwich the sample sheets between the aluminum plates. A load of 20 g·f/cm2 was applied to the assembly from the top thereof. In this state, the assembly was allowed to stand in a constant-temperature oven at 60° C. for 7 days. Thereafter, a cyan image was recorded on the surface of the receptive layer of each sample under the same conditions as described above, and the presence and degree of unevenness of the recorded image were evaluated by visual inspection.

Criteria for evaluation

O: Substantially no unevenness observed in appearance.

Δ: Indistinct unevenness observed.

X: Distinct unevenness observed.

4) Overall evaluation

◎: Very good

O: Good

X: Impossible to practice

TABLE B1

| Sample under test | Overall evaluation | Releasability of back surface of image-receiving sheet in the case of abnormal transfer | Stain resistance of back surface of image-receiving sheet | Unevenness of printed image on image-receiving sheet |
|---|---|---|---|---|
| Ex. B1 | ○ | ○ | A | Δ |
| Ex. B2 | ○ | ○ | B | ○ |
| Ex. B3 | ○ | ○ | A | Δ |
| Ex. B4 | ◎ | ○ | A | ○ |
| Ex. B5 | ◎ | ○ | A | ○ |
| Ex. B6 | ◎ | ○ | A | ○ |
| Ex. B7 | ◎ | ○ | A | ○ |
| Ex. B8 | ○ | ○ | B | Δ |
| Ex. B9 | ◎ | ○ | A | ○ |
| Ex. B10 | ◎ | ○ | A | ○ |

TABLE B1-continued

| Sample under test | Overall evaluation | Releasability of back surface of image-receiving sheet in the case of abnormal transfer | Stain resistance of back surface of image-receiving sheet | Unevenness of printed image on image-receiving sheet |
|---|---|---|---|---|
| Ex. B11 | ◎ | ○ | A | ○ |
| Ex. B12 | ○ | ○ | B | ○ |
| Ex. B13 | ◎ | ○ | A | ○ |
| Ex. B14 | ○ | ○ | B | ○ |
| Ex. B15 | ◎ | ○ | A | ○ |
| Ex. B16 | ◎ | ○ | A | ○ |
| Ex. B17 | ◎ | ○ | A | ○ |
| Ex. B18 | ○ | ○ | B | ○ |
| Comp. Ex. B1 | x | x | C | — |
| Comp. Ex. B2 | x | x | A | — |
| Comp. Ex. B3 | x | x | C | — |
| Comp. Ex. B4 | x | x | B | — |

As is apparent from the foregoing detailed description, in the thermal transfer image-receiving sheet according to the second aspect of the present invention, since the dye-unreceptive layer provided on the back surface of the image-receiving sheet contains a release agent, the releasability of the back surface is so good that even when the image-receiving sheet is fed into a printer with the back surface of the image-receiving sheet being erroneously recognized as the image-receiving surface and, in this state, thermal transfer is carried out, the image-receiving sheet can be successfully delivered from the printer without heat fusing or sticking between the thermal transfer sheet and the back surface of the image-receiving sheet. Further, since the back surface of the image-receiving sheet has no receptivity to dye, even when image-receiving sheets with an image being recorded thereon are put on top of one another for storage, there is no possibility that the back surface is stained with a dye. Thus, it is possible to provide a thermal transfer image-receiving sheet having excellent service properties.

Further, when the release agent used in the dye-unreceptive layer is the same as that contained in the receptive layer, there is no possibility that the receptivity to a dye of the receptive layer is not deteriorated even though part of the release agent migrates to the receptive layer.

Furthermore, when the release agent contained in the dye-unreceptive layer is of such a type as will cause no migration to other places such as the receptive layer, the above-described releasing effect becomes stable and, at the same time, the adverse effect of the release agent on the dye receptivity of the receptive layer and the carriability of the image-receiving sheet, such as automatic feed and delivery of the image-receiving sheet in a printer.

Specific examples of such release agents include an amino-modified silicone and an epoxy-modified silicone, a cured product obtained by a reaction of both the above modified silicones, an addition-polymerizable silicone and a cured product obtained by a reaction of the addition-polymerizable silicone. The use of these silicones provides the above effects.

Further, when the dye-unreceptive layer contains at least one thermoplastic resin and/or organic or inorganic filler, the lubricity of the back surface of the image-receiving sheet can be controlled as desired, which improves and stabilizes the carriability of the image-receiving sheet in a printer. Furthermore, in this case, since the surface of the dye-unreceptive layer becomes finely uneven, even when the image-receiving sheets after printing are put on top of another and, in this state, are stored, the image-receiving surface is not adhered to the back surface of the image-receiving sheet, so that the effect of preventing the back surface from staining with a sublimable dye can also be attained.

Example C1

Synthetic paper (Yupo FPG#150 having a thickness of 150 $\mu$m; manufactured by Oji-Yuka Synthetic Paper Co., Ltd.) was used as a substrate sheet, and a coating solution having the following composition for a dye-receptive layer was coated by means of a bar coater on one surface of the synthetic paper so that the coverage on a dry basis was 5.0 g/m$^2$, and the resultant coating was dried. Subsequently, a coating solution having the following composition for a primer layer and a coating solution having the following composition for a lubricious back surface layer were successively coated on the other surface of the synthetic paper respectively at coverages on a dry basis of 0.2 g/m$^2$ and 1.0 g/m$^2$ by means of a bar coater, and, after each coating, the resultant coating was dried, thereby preparing a thermal transfer image-receiving sheet of Example C1.

| Composition of coating solution for dye-receptive layer | |
|---|---|
| Polyester resin (Vylon 600 manufactured by Toyobo Co., Ltd.) | 40 parts by weight |
| Vinyl chloride/vinyl acetate copolymer (#1000A manufactured by Denki Kagaku Kogyo K.K) | 60 parts by weight |
| Addition-polymerizable silicone (X-62-1212 manufactured by The Shin-Etsu Chemical Co., Ltd.) | 10 parts by weight |
| Catalyst (PL50T manufactured by The Shin-Etsu Chemical Co., Ltd.) | 5 parts by weight |
| Solvent (methyl ethyl ketone/toluene; weight ratio = 1:1) | 885 parts by weight |

Methyl ethyl ketone will be hereinafter referred to as "MEK."

| Composition of coating solution for primer layer | |
|---|---|
| Urethane resin (Nippollan 5199 manufactured by Nippon Polyurethane Industry Co., Ltd.) | 25 parts by weight |
| Solvent (isopropyl alcohol/toluene/MEK; weight ratio = 1:2:2) | 75 parts by weight |

Isopropyl alcohol will be hereinafter referred to as "IPA."

| Composition of coating solution for lubricious back surface layer | |
|---|---|
| Acrylic resin (BR85 manufactured by Mitsubishi Rayon Co.,) | 10 parts by weight |
| Nylon 12 filler (MW330 manufactured by Shinto Paint Co., Ltd.) | 2 parts by weight |
| Solvent (MEK/toluene; weight ratio = 1:1) | 88 parts by weight |

Example C2

A thermal transfer image-receiving sheet of Example C2 was prepared in the same manner as in Example C1, except that the coating solution for a lubricious back surface layer had the following composition.

| Composition of coating solution for lubricious back surface layer | |
|---|---|
| Acrylic resin (BR80 manufactured by Mitsubishi Rayon Co.,) | 10 parts by weight |
| Nylon 12 filler (MW330 manufactured by Shinto Paint Co., Ltd.) | 2 parts by weight |
| Solvent (MEK/toluene; weight ratio = 1:1) | 88 parts by weight |

Example C3

A thermal transfer image-receiving sheet of Example C3 was prepared in the same manner as in Example C1, except that the coating solution for a lubricious back surface layer had the following composition.

| Composition of coating solution for lubricious back surface layer | |
|---|---|
| Acrylic resin (BR113 manufactured by Mitsubishi Rayon Co., Ltd.) | 10 parts by weight |
| Nylon 12 filler (MW330 manufactured by Shinto Paint Co., Ltd.) | 2 parts by weight |
| Solvent (MEK/toluene; weight ratio = 1:1) | 88 parts by weight |

Example C4

A thermal transfer image-receiving sheet of Example C4 was prepared in the same manner as in Example C1, except that the coating solution for a primer layer and the coating solution for a lubricious back surface layer had the following respective compositions.

| Composition of coating solution for primer layer | |
|---|---|
| Polyolefin resin (Unistole R300 manufactured by Mitsui Petrochemical Industries, Ltd.) | 35 parts by weight |
| Solvent (toluene) | 65 parts by weight |

| Composition of coating solution for lubricious back surface layer | |
|---|---|
| Amorphous polyolefin resin (Zeonex 480 manufactured by Nippon Zeon Co., Ltd.) | 10 parts by weight |
| Nylon 12 filler (MW330 manufactured by Shinto Paint Co., Ltd.) | 2 parts by weight |
| Solvent (toluene) | 88 parts by weight |

Example C5

A thermal transfer image-receiving sheet of Example C5 was prepared in the same manner as in Example C1, except that the coating of the primer layer was omitted and the coating solution for a lubricious back surface layer had the following composition.

| Composition of coating solution for lubricious back surface layer | |
|---|---|
| Polyvinyl butyral resin (3000-1 manufactured by Denki Kagaku Kogyo K.K) | 10.0 parts by weight |
| Chelate agent (Tenkarate TP110) | 4.3 parts by weight |
| Nylon 12 filler (MW330 manufactured by Shinto Paint Co., Ltd.) | 2 parts by weight |
| Solvent (MEK/toluene; weight ratio = 1:1) | 83.7 parts by weight |

Example C6

A thermal transfer image-receiving sheet of Example C6 was prepared in the same manner as in Example C1, except that the coating of the primer layer was omitted and the coating solution for a lubricious back surface layer had the following composition.

| Composition of coating solution for lubricious back surface layer | |
|---|---|
| Melamine resin (Cymel 303 manufactured by Mitui-Cyanamid, Ltd.) | 10 parts by weight |
| Catalyst (Catalyst 6000 manufactured by Mitsui Toatsu Chemicals, Inc.) | 5 parts by weight |
| Nylon 12 filler (MW330 manufactured by Shinto Paint Co., Ltd.) | 2 parts by weight |
| Solvent (MEK/toluene; weight ratio = 1:1) | 83 parts by weight |

Example C7

A thermal transfer image-receiving sheet of Example C7 was prepared in the same manner as in Example C1, except that a nylon 6 filler was used as the filler added to the coating solution for a lubricious back surface layer instead of the nylon 12 filler.

The construction of comparative thermal transfer image-receiving sheets will now be described.

Thermal transfer image-receiving sheets of

Comparative Examples C1 to C7 were prepared in the same manner as in Example C1, except that the coating solution for a lubricious back surface layer was prepared by using the following fillers instead of the nylon 12 filler.

(Comparative Example C1) A thermal transfer image-receiving sheet prepared by using polyethylene wax (particle diameter: 10 $\mu$m) instead of the nylon 12 filler.

(Comparative Example C2) A thermal transfer image-receiving sheet prepared by using teflon powder (particle diameter: 0.5 $\mu$m) instead of the nylon 12 filler.

(Comparative Example C3) A thermal transfer image-receiving sheet prepared by using talc (particle diameter: 1.8 $\mu$m) instead of the nylon 12 filler.

(Comparative Example C4) A thermal transfer image-receiving sheet prepared by using clay (particle diameter: 0.4 $\mu$m) instead of the nylon 12 filler.

(Comparative Example C5) A thermal transfer image-receiving sheet prepared by using acrylic beads (particle diameter: 10 $\mu$m) instead of the nylon 12 filler.

(Comparative Example C6) A thermal transfer image-receiving sheet prepared by using ethylenebisamide instead of the nylon 12 filler.

(Comparative Example C7) A thermal transfer image-receiving sheet prepared by using silicone powder (particle diameter: 1.5 μm) instead of the nylon 12 filler.

(Tests and results)

The thermal transfer image-receiving sheets of Examples C1 to C7 and Comparative Examples C1 to C7 thus prepared subjected to tests for the following items, and the results are given in Tables C1 and C2.

1) Coefficient of friction between image-receiving surface and back surface of image-receiving sheet (lubricity)

Figure 3:
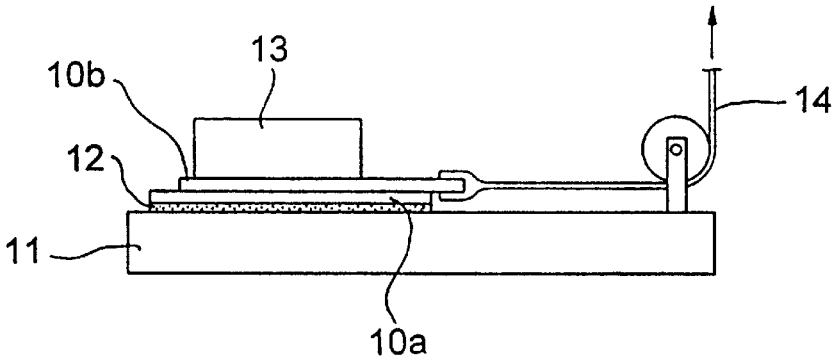
FIG. 3 is a schematic view of the essential part showing the measurement of coefficient of friction between the image-receiving surface and the back surface of thermal transfer image-receiving sheets.

The measurement of coefficient of friction between the image-receiving surface and the back surface of the image-receiving sheet was made with a tensile strength tester (Tensilon UCT100 manufactured by Orientec Co. Ltd.) by a method shown in FIG. 3. A first image-receiving sheet 10*a* is fixed to a table 11 via an adhesive layer 12. A second image-receiving sheet 10b is stacked on the first image-receiving sheet 10*a*. A weight 13 is positioned on the second image-receiving sheet, while the second image-receiving sheet is pulled by a cable 14 that is connected to a Tensilon load cell (not shown). The dimension of the image-receiving sheets was 150 mm×100 mm. The weight was 2000 g and the bottom face area of the weight was 90 mm×45 mm. The second image-receiving sheet 10*b* was pulled at a pulling rate of 500 mm/min. The coefficient of friction was expressed as a value obtained by dividing the measured value (g) by the load 2000 g of the weight.

Figure 4:
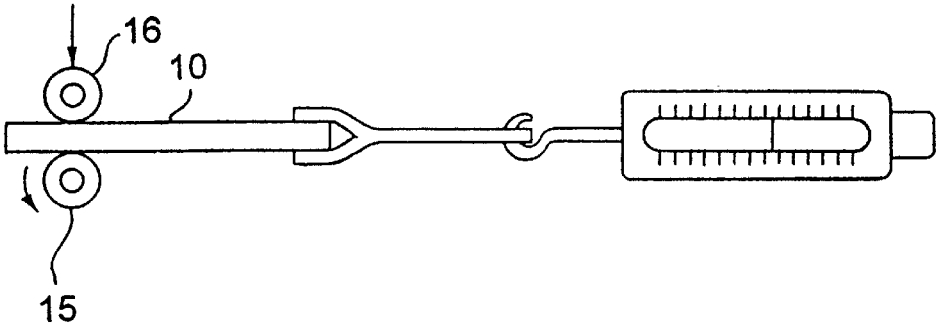
FIG. 4 is a schematic view showing the measurement of coefficient of friction between the back surface of a thermal transfer image-receiving sheet and a rubber roll for the feed and delivery of sheets in a printer.

2) Coefficient of friction between back surface of image-receiving sheet and rubber roll of printer for feeding paper In a device as shown in FIG. 4, an image-receiving sheet 10 was positioned between a rubber drive roll 15 on its front surface and a plastic roll 16 on its back surface. The dimension of the image-receiving sheet was 150 mm×100 mm. The rubber drive roll 15 was rotated at surface velocity of 6 cm/sec and the plastic roll 16 was placed under a load of 300 g, as illustrated by the arrow in FIG. 4. Fifteen seconds, after the initiation of the rotation of roll 15, the scale (g) of a fixed spring balance to which the image-receiving sheet was connected, was read. The measured value was divided by the load to determine the coefficient of friction of the back surface of the image-receiving sheet.

3) Dye offset resistance of back surface of image-receiving sheet

A gradation pattern was printed on each thermal transfer image-receiving sheet by utilizing a transfer sheet using a cyan dye by means of a thermal dye sublimation transfer printer (VY-50 manufactured by Hitachi, Ltd.). The printed sheet was used as a sample, and the sample was cut into a size of 14×4 cm. The cut sheets were put on top of another in such a manner that the surface with an image being formed thereon faced the back surface. A smooth aluminum plate was put on each of the uppermost sheet and the lowermost sheet to sandwich the sheets between the aluminum plates. A load of 1.5 kg was applied to the assembly from the top thereof. In this state, the assembly was allowed to stand in a constant-temperature oven at 50° C. for 7 days. Thereafter, the cut sheet samples were taken out of the oven, and the maximum color density of the back surface of the sheet sample was measured by a Macbeth color densitometer.

TABLE C1

| Sample | Filler/ resin (filler particle diameter) | Coefficient of friction between image-receiving surface and back surface of image-receiving sheet | Coefficient of friction between back surface of image-receiving sheet and rubber roll | Offset resistance |
|---|---|---|---|---|
| Ex. C1 | Nylon 12/ BR85 (5–8 μm) | 0.28 | 1.30 | 0.01 |
| Ex. C2 | Nylon 12/ BR80 (5–8 μm) | 0.33 | 1.09 | 0.01 |
| Ex. C3 | Nylon 12/ BR113 (5–8 μm) | — | — | 0.01 |
| Ex. C4 | Nylon 12/ Zeonex 480 (5–8 μm) | 0.30 | 1.09 | 0.01 |
| Ex. C5 | Nylon 12/ PVB 3000-1 (5–8 μm) | 0.18 | 1.30 | 0.01 |
| Ex. C6 | Nylon 12/ Cymel 303 (5–8 μm) | — | — | 0.01 |
| Ex. C7 | Nylon 6/ BR85 | 0.30 | 1.09 | 0.02 |

TABLE C2

| Sample | Filler/ resin (filler particle diameter) | Coefficient of friction between image-receiving surface and back surface of image-receiving sheet | Coefficient of friction between back surface of image-receiving sheet and rubber roll | Offset resistance |
|---|---|---|---|---|
| Comp. Ex. C1 | PE wax/ BR85 (10 μm) | 0.36 | 0.88 | 0.07 |
| Comp. Ex. C2 | Teflon powder/ BR85 (0.5 μm) | 0.41 | 0.88 | 0.03 |
| Comp. Ex. C3 | Talc/ BR85 (1.8 μm) | 0.37 | 0.94 | 0.06 |
| Comp. Ex. C4 | Clay/ BR85 (0.4 μm) | 0.48 | 0.17*2 | 0.05 |
| Comp. Ex. C5 | Acrylic bead/ BR85 (10 μm) | 0.49*1 | 0.17 | 0.07 |
| Comp. Ex. C6 | Ethylene-bisamide/ BR85 | 0.29 | 1.09 | 0.03 |
| Comp. Ex. C7 | Silicone powder/ BR85 (1.5 μm) | 0.41 | 0.94*3 | 0.07 |

Note)

*1Stick slip phenomenon (a slip phenomenon in which the sheet is not smoothly slipped due to sticking.)

*2Rubber powder was adhered onto the back surface of image-receiving sheet.

*3Silicone powder was adhered onto the rubber roll.

(Evaluation of measured values)

1) The lower the coefficient of friction between the image-receiving surface and the back surface of the image-receiving sheet, the better the results.

2) The higher the coefficient of friction between the back surface of the image-receiving sheet and the rubber roll of the printer for feeding paper, the better the results.

3) The lower the numerical value for expressing the dye offset resistance of the back surface of the image-receiving sheet, the better the results.

Apart from the above tests, in order to evaluate the feedability, deliverability and carriability of the image-receiving sheets under a high-temperature and high-humidity environment, a printing test on samples of Example C1 (nylon 12 filler used) and Example 7 (nylon 6 filler used) was made where printing was carried out on 50 sheets of sample in a continues manner by means of a thermal dye sublimation transfer printer (VY-50) under an environment of 35° C. and 80% RH. As a result, no failure occurred for the image-receiving sheet of Example C1, whereas a failure of the image-receiving sheet to be fed occurred for two sheets of the image-receiving sheet sample of Example C7.

This indicates that the nylon 12 filler can maintain the effect even under high-temperature and high-humidity environments.

The thermal transfer image-receiving sheet according to the third aspect of the present invention comprises a substrate sheet, a dye-receptive layer provided on one surface of the substrate sheet and a lubricious back surface layer provided on the other surface of the substrate sheet, the lubricious back surface layer being composed mainly of a binder and a nylon filler. By virtue of the above construction, the surface of the lubricious back surface layer of the image-receiving sheet is finely uneven, which contributes to an improvement in lubricity and blocking resistance. Further, the nylon filler has a high melting point, a self-lubricity and excellent oil and chemical resistance. By virtue of these properties, troubles in a printer can be eliminated such as feed of a plurality of sheets in an overlapped state and other troubles during carrying such as in automatic feed and delivery. Furthermore, even though the temperature of the image-receiving sheet is raised within a printer, the lubricity and the blocking resistance are not deteriorated, so that stable properties can be obtained. Furthermore, even when a plurality of image-receiving sheets are put on top of one another with the surface of the print facing the back surface and, in this state, are stored, the offset of the sublimable dye onto the back surface of the image-receiving sheet can be prevented. Thus, according to the present invention, a thermal transfer-image receiving sheet having the above excellent properties can be provided.

In the thermal transfer image-receiving sheet according to the present invention, the nylon filler added to the back surface layer is a nylon 12 filler. The nylon 12 filler is superior to nylon 6 and nylon 66 in water resistance and less likely to absorb water, so that under high-temperature and high-humidity conditions it gives rise to no change in properties and can stably exhibit the above properties.

Further, in the thermal transfer image-receiving sheet according to the present invention, the nylon filler may be spherical and have a molecular weight in the range of from 100,000 to 900,000.

This embodiment contributes to a further improvement in lubricity and blocking resistance of the back surface of the image-receiving sheet and an improvement in abrasion resistance of the filler. Therefore, there is no possibility that powder generated by abrasion is adhered to the rubber roller and the like and damages the rubber roller and other counter materials.

Furthermore, in the thermal transfer image-receiving sheet according to the present invention, the nylon filler may have an average particle diameter in the range of from 0.01 to 30 $\mu$m. This embodiment prevents the nylon filler from being buried in the back surface layer or prevents excessive protrusion of the nylon filler from the back surface layer which enhances the coefficient of friction or causes falling of the filler, so that the contemplated properties can be stably attained.

Furthermore, in the thermal transfer image-receiving sheet according to the present invention, the binder may be a resin undyeable with a sublimable dye. According to this embodiment in combination with the uneven back surface, the resistance to stain with a sublimable dye can be further improved, and the offset of a sublimable dye hardly occurs even when the image-receiving sheets after printing are put on top of one another in such a manner that the surface with an image being formed thereon faced the back surface, and, in this state, are stored.

We claim:

1. A thermal transfer image-receiving sheet comprising a substrate sheet, a dye-receptive layer provided on one surface of said substrate sheet and a dye-unreceptive layer provided on the other surface of said substrate sheet, said dye-unreceptive layer comprising at least one release agent at least one of which does not migrate to said dye-receptive layer, said non-migrating release agent being a three-dimensional crosslinked silicone or a reactive silicone oil.

2. A thermal transfer image-receiving sheet comprising a substrate sheet, a dye-receptive layer provided on one surface of said substrate sheet and a dye-unreceptive layer provided on the other surface of said substrate sheet, said dye-unreceptive layer comprising at least one release agent at least one of which comprises a cured product obtained by a reaction of a reactive silicone oil.

3. A thermal transfer image-receiving sheet comprising a substrate sheet, a dye-receptive layer provided on one surface of said substrate sheet and a dye-unreceptive layer provided on the other surface of said substrate sheet, said dye-unreceptive layer comprising: (i) at least one release agent that is the same as that contained in said dye-receptive layer; (ii) at least one release agent that does not migrate to said dye-receptive layer, said non-micrating release agent being a three-dimensional crosslinked silicone or a reactive silicone oil; or (iii) at least one release agent that comprises a cured product obtained by a reaction of a reactive silicone oil.

* * * * *